US008051626B2

(12) United States Patent
Ubiñana Felix

(10) Patent No.: US 8,051,626 B2
(45) Date of Patent: Nov. 8, 2011

(54) PURLIN BEAM WITH CONNECTABLE TERMINALS

(75) Inventor: José Luis Ubiñana Felix, Parets Del Valles (ES)

(73) Assignee: Sistemas Technicos de Encofrados, S.A., Barcelona (ES)

( * ) Notice: Subject to any disclaimer, the term of this patent is extended or adjusted under 35 U.S.C. 154(b) by 943 days.

(21) Appl. No.: 11/995,088

(22) PCT Filed: Jun. 23, 2006

(86) PCT No.: PCT/ES2006/000371

§ 371 (c)(1),
(2), (4) Date: Jan. 24, 2008

(87) PCT Pub. No.: WO2007/006825

PCT Pub. Date: Jan. 18, 2007

(65) Prior Publication Data

US 2008/0196357 A1 Aug. 21, 2008

(30) Foreign Application Priority Data

Jul. 11, 2005 (ES) ..... 200501680

(51) Int. Cl.
*E04B 2/00* (2006.01)

(52) U.S. Cl. ..... 52/848; 52/582.2; 52/655.1; 403/353; 446/120

(58) Field of Classification Search ..... 52/578, 52/582.2, 655.1, 848; 403/331, 286, 293, 403/300, 302, 311, 353, 354, 374.5; 446/120–121
See application file for complete search history.

(56) References Cited

U.S. PATENT DOCUMENTS

| | | | | | |
|---|---|---|---|---|---|
| 721,427 | A | * | 2/1903 | Cope | 403/353 |
| 1,533,724 | A | * | 4/1925 | Clarke-James | 403/361 |
| 2,127,285 | A | * | 8/1938 | Brecht | 433/182 |
| 2,154,570 | A | * | 4/1939 | Holmstrom | 52/210 |
| 3,037,593 | A | * | 6/1962 | Webster | 52/476 |
| 3,055,461 | A | * | 9/1962 | De Ridder | 52/588.1 |
| 3,332,197 | A | * | 7/1967 | Hinkle | 52/844 |
| 3,431,694 | A | | 3/1969 | Hunnebeck | |
| 3,522,684 | A | * | 8/1970 | Grossman | 52/393 |
| 3,565,264 | A | * | 2/1971 | Guiher | 211/117 |
| 3,627,364 | A | * | 12/1971 | Van Riet | 403/241 |
| 3,685,866 | A | * | 8/1972 | Patenaude | 403/189 |
| 3,894,377 | A | * | 7/1975 | Welch | 52/584.1 |
| 4,019,302 | A | * | 4/1977 | Meyer | 52/843 |
| 4,159,601 | A | * | 7/1979 | Ebert et al. | 52/36.5 |
| 4,171,173 | A | * | 10/1979 | Hymans | 403/189 |

(Continued)

FOREIGN PATENT DOCUMENTS

EP 7397 A1 * 2/1980

(Continued)

*Primary Examiner* — Robert Canfield
*Assistant Examiner* — Charissa Ahmad
(74) *Attorney, Agent, or Firm* — Birch, Stewart, Kolasch & Birch, LLP

(57) ABSTRACT

The beam has end terminals which can be connected to one another, such that one of the terminals is provided with front projections for guiding in vertical displacement of the other terminal, which has guides with a form which mates with the said projections, one of the terminals also having projecting lower arms to support the other terminal after it has been put into position, thus determining a single area of contact in order to permit disconnection of the supported terminal during dismantling, by turning on the said area of contact.

14 Claims, 30 Drawing Sheets

U.S. PATENT DOCUMENTS

| | | | | |
|---|---|---|---|---|
| 4,441,291 | A * | 4/1984 | Sokoler et al. | 52/309.1 |
| 4,496,262 | A * | 1/1985 | Sangster | 403/335 |
| 4,538,392 | A * | 9/1985 | Hamar et al. | 52/584.1 |
| 5,181,352 | A * | 1/1993 | Friedman | 52/58 |
| 5,222,902 | A * | 6/1993 | Piersch | 446/121 |
| 5,244,300 | A * | 9/1993 | Perreira et al. | 403/381 |
| 5,577,856 | A * | 11/1996 | Tezuka | 403/294 |
| 5,727,358 | A * | 3/1998 | Hayashi et al. | 52/745.2 |
| 5,779,380 | A * | 7/1998 | Knapp | 403/331 |
| 5,857,304 | A * | 1/1999 | Karten et al. | 52/582.1 |
| 6,018,920 | A * | 2/2000 | Fancher | 52/582.2 |
| 6,397,551 | B1 * | 6/2002 | Lewcock et al. | 52/655.1 |
| 6,408,587 | B2 * | 6/2002 | Cronin et al. | 52/637 |
| 6,648,715 | B2 * | 11/2003 | Wiens et al. | 446/121 |
| 6,659,295 | B1 * | 12/2003 | De Land et al. | 211/187 |
| 6,779,315 | B1 * | 8/2004 | Bongio et al. | 52/506.07 |
| 6,837,016 | B2 * | 1/2005 | Simmons et al. | 52/655.1 |
| 6,969,211 | B2 * | 11/2005 | Altman | 403/374.4 |
| 7,841,141 | B2 * | 11/2010 | Nordli | 52/233 |
| 2009/0293405 | A1 * | 12/2009 | Andrews et al. | 52/578 |

FOREIGN PATENT DOCUMENTS

| | | |
|---|---|---|
| ES | 1010965 | 3/1990 |
| ES | 2156682 | 7/2001 |
| ES | 1050903 | 6/2002 |
| ES | 2193870 | 11/2003 |
| ES | 2209670 | 6/2004 |
| FR | 1117229 | 5/1956 |
| FR | 1460514 | 1/1966 |
| WO | WO 9415035 A1 * | 7/1994 |

* cited by examiner

PURLIN BEAM WITH CONNECTABLE TERMINALS

CROSS-REFERENCE TO RELATED APPLICATIONS

This application is a 371 National Phase of International Application No. PCT/ES2006/000371, filed Jun. 23, 2006, which claims priority under 35 U.S.C. §119 to Spanish Application No. 200501680 filed Jul. 11, 2005. International Application No. PCT/ES2006/000371 published in Spanish on Jan. 18, 2007. These applications are hereby incorporated by reference in their entireties.

The present invention is intended to disclose a purlin or runner beam with connectable terminals which facilitates considerably the assembly of concrete shuttering for forged parts for floors.

The object of the present invention is to provide a purlin beam to support shuttering panels for reinforced concrete parts for floors, which makes possible rapid assembly with reference to an adjacent purlin beam, each purlin beam comprising a male terminal at one end and a female terminal at the other end, which can easily be connected to one another. The connection of a male end of a purlin beam to the corresponding female end of the adjacent purlin beam is based on the principle of a tilting catch at one end of the purlin beam and a horizontal latch for the connection of the catch situated at the other end of the purlin beam, as disclosed in Publication No. ES 2258361 for a "Device for connection of beams for shuttering".

The purlin beam with connectable terminals which is the subject of the present invention has cast terminals, which for example are made of high-strength malleable cast iron, steel or another material, or which are made of steel plate elements which are incorporated in the ends of the tubular body of the purlin beam. In one of the versions of the invention, one of the terminals has projecting centring areas and a front bridge forming a crossbar for interaction with the catch of the opposite terminal, and there are also heel plates with an arched upper surface which determine the place of support of the terminal of the adjacent beam, which in turn has vertical guides which are designed to be displaced and centred on the centring projections of the female part, and also has the retention catch fitted on its interior.

The centring projections of a terminal can have the structure of simple projections with inner surfaces opposite one another for guiding of the other terminal, and upper intake chamfers, or they can have continuous guides which extend from the top of the part downwards, and are designed to receive a mating vertical guide form of the other terminal, which supports the catch. The vertical guides can also have a structure consisting of angled surfaces which mate with other angled surfaces of the other male terminal, or in general any structure which permits vertical entry of one terminal onto the other with guiding of one part into the other, and with abutments to delimit the vertical position of one beam relative to another adjacent beam connected to the first.

The beams are dismantled by tilting the beam which supports the male terminal or the female terminal of a specific connection. In order to facilitate the dismantling, which will take place by turning the beam at the point of articulation, it must be ensured that the upper end of the support beam of one or the other of the terminals can be turned without interference with the forged floor part of which it has formed the shuttering. For this purpose, there must exist the appropriate arrangement with respect to the point of turning, which permits direct turning of the terminal, or there must be a small recess or curvature in the terminal area of the beam, so as to allow it to be turned without interference.

Drawings which illustrate a preferred embodiment of the invention are appended, in order to assist understanding of it, by way of non-limiting explanatory example.

Figure 16:
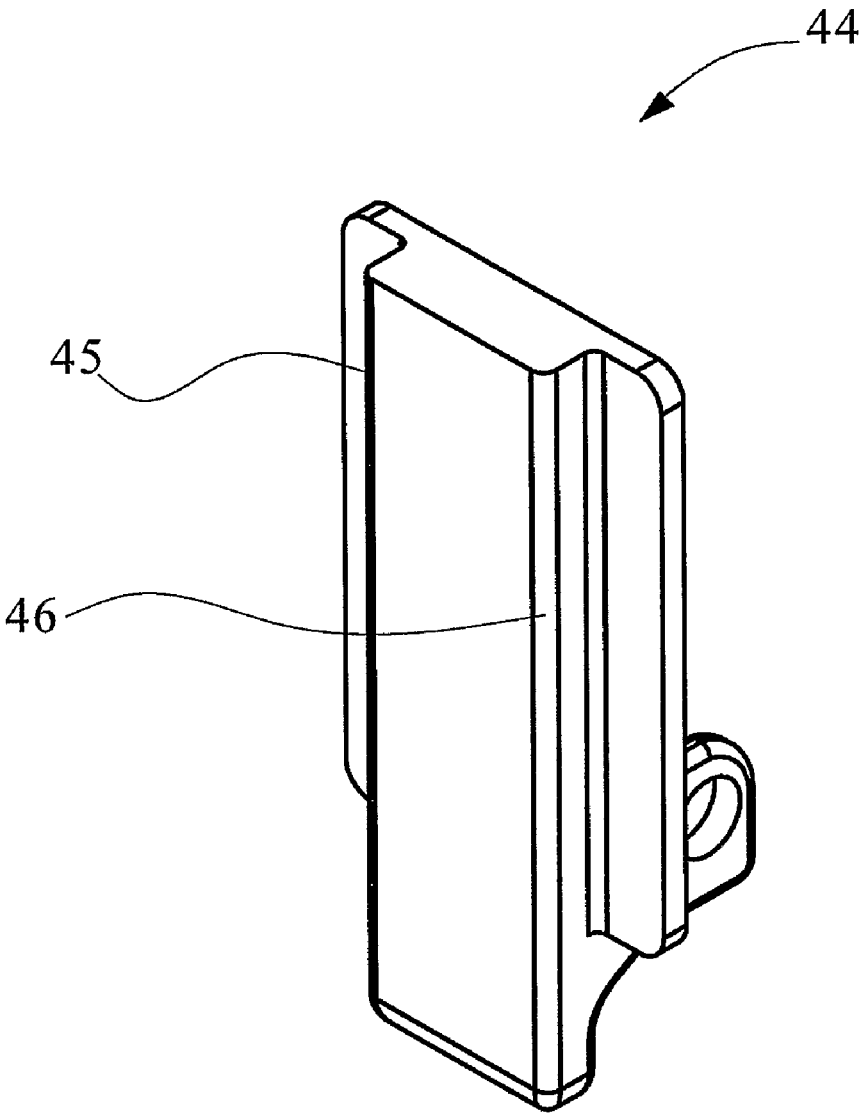
Figure 17:
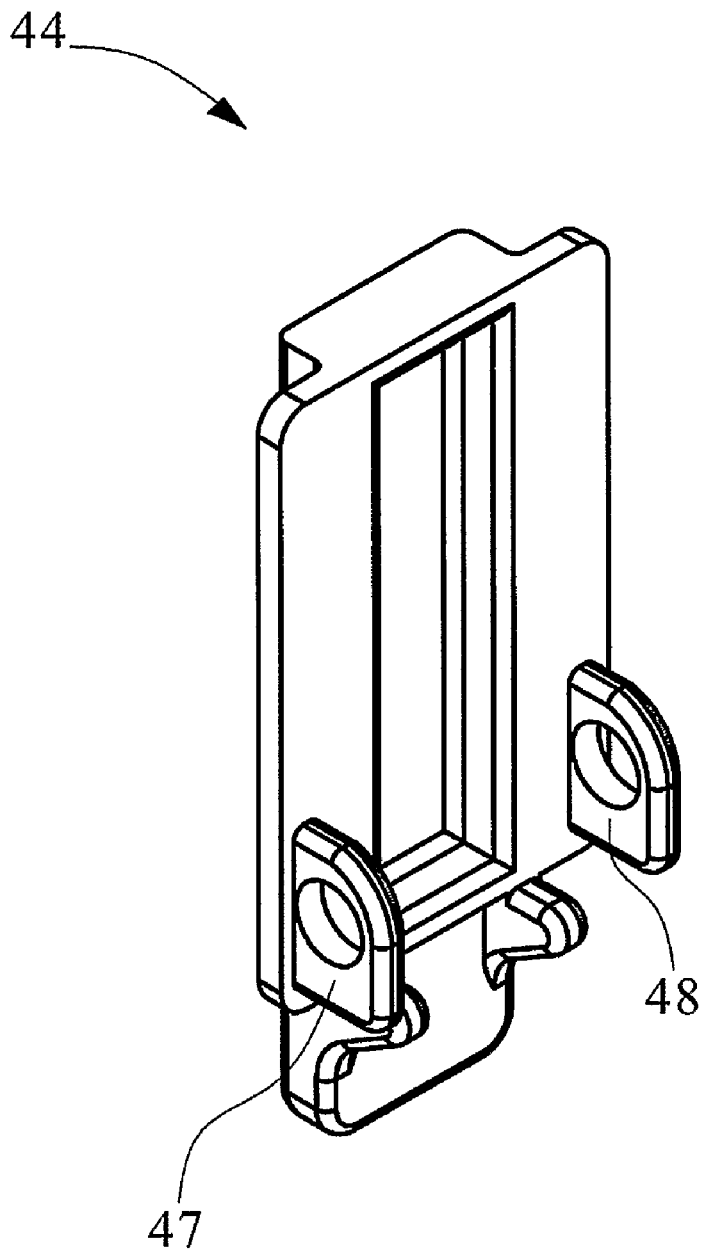
Figure 18:
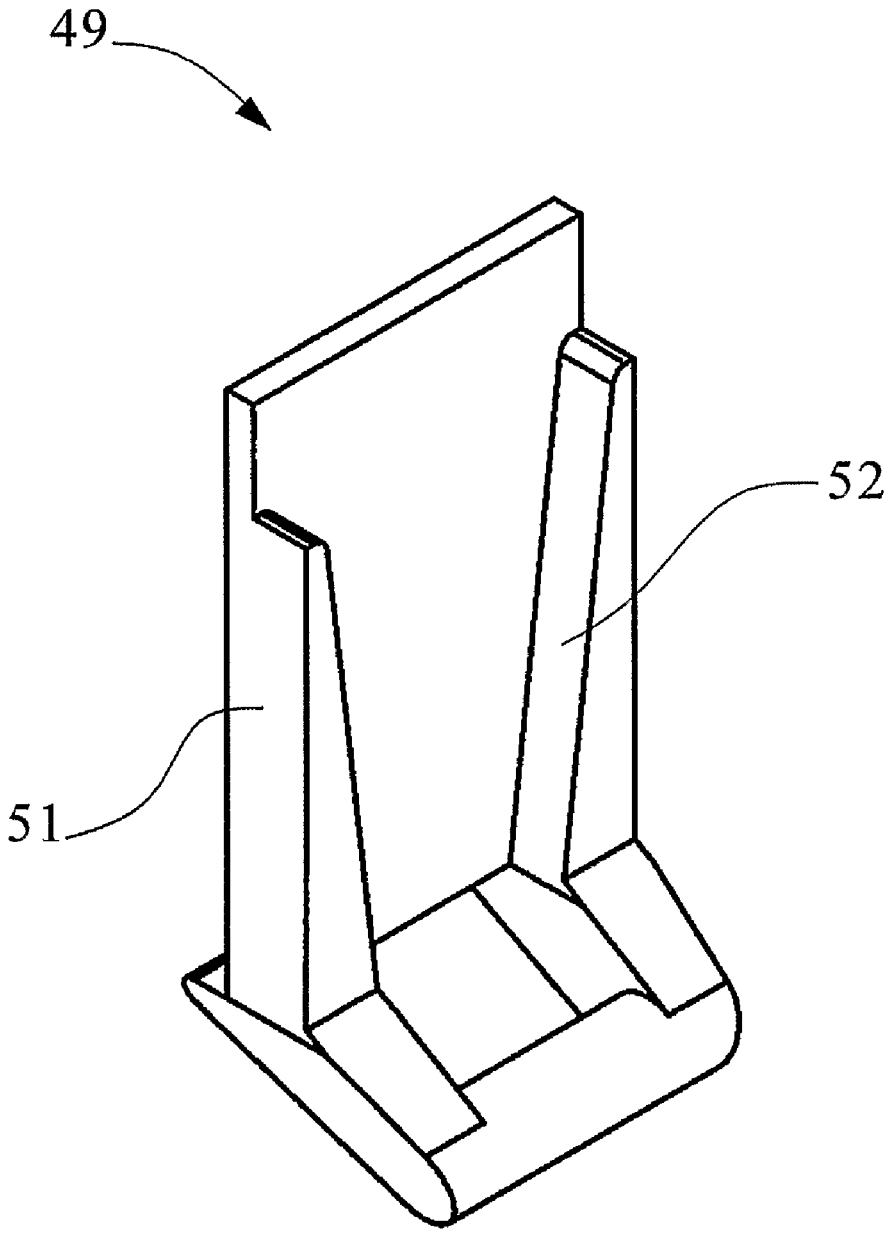
Figure 19:
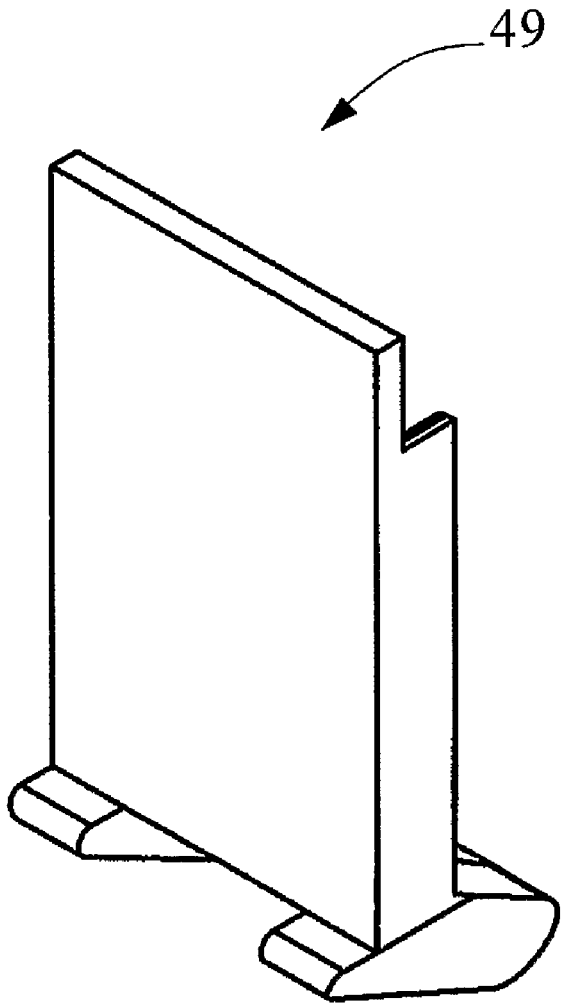
Figure 20:
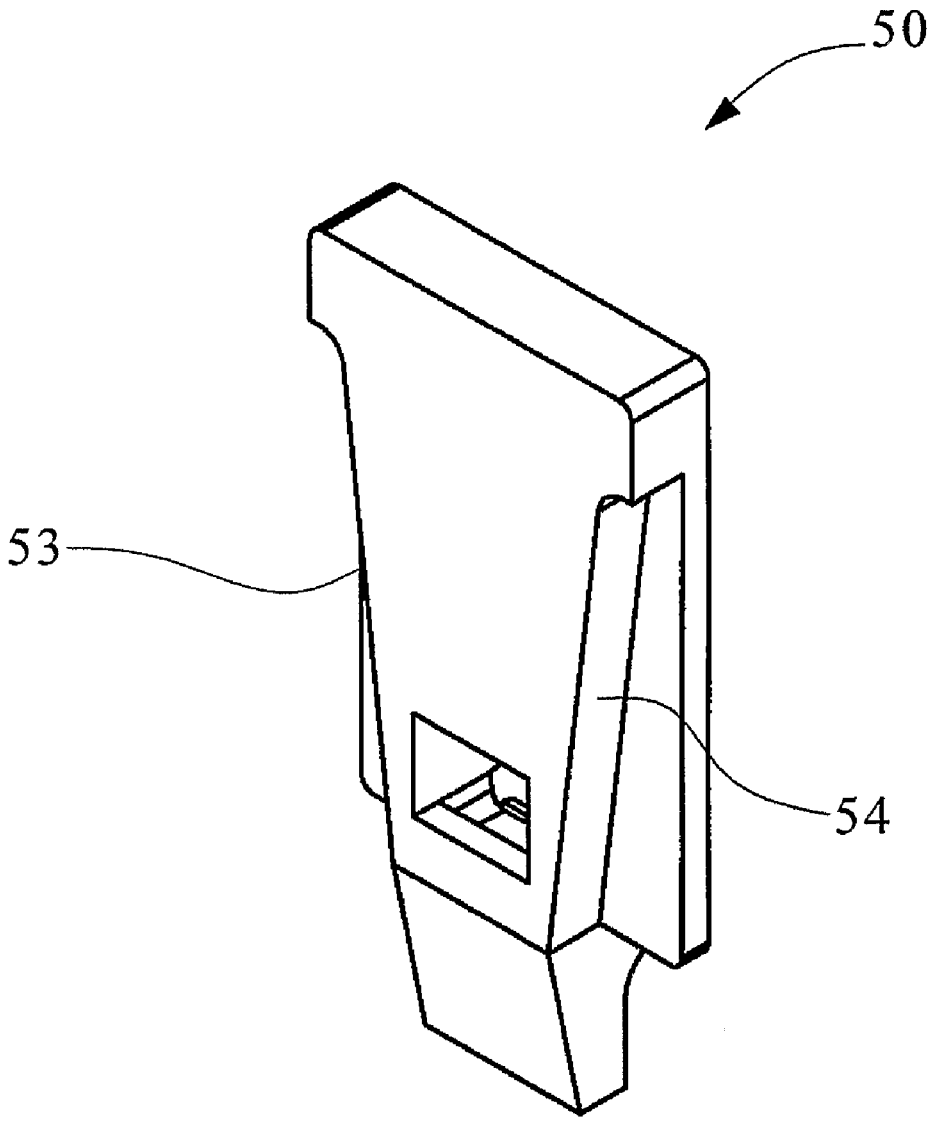
Figure 21:
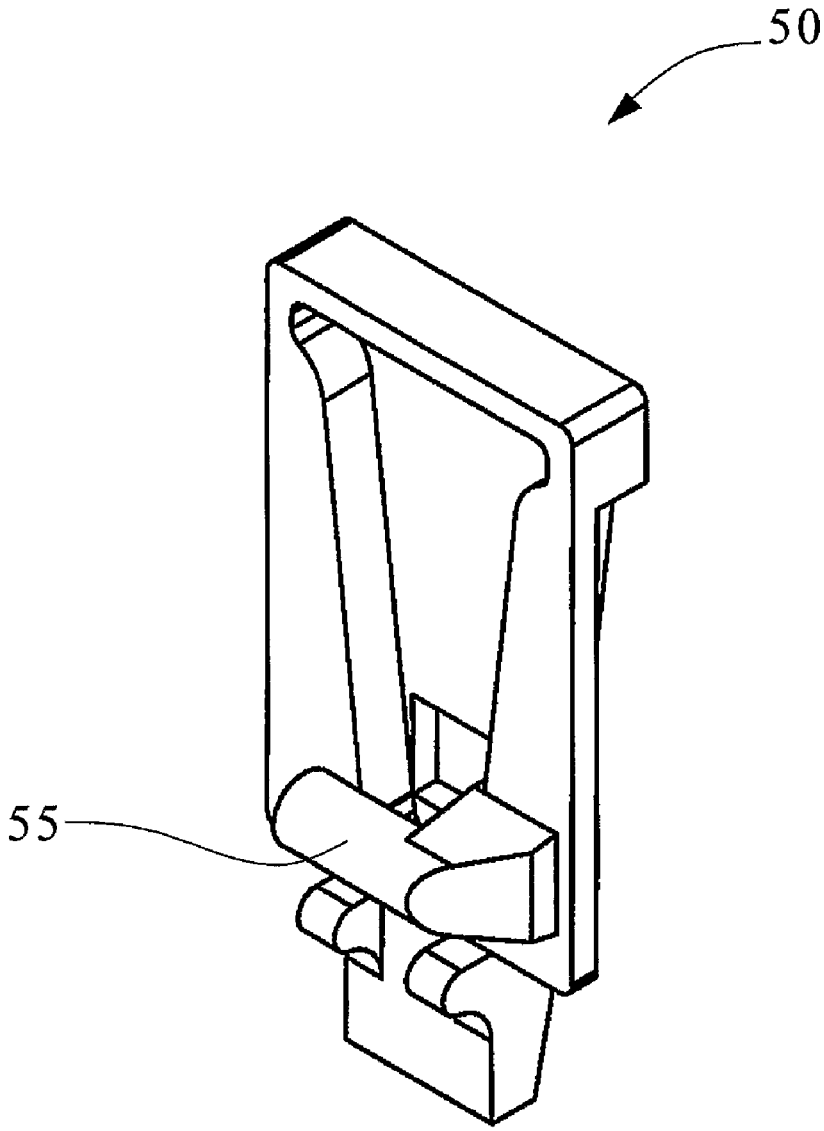
Figure 22:
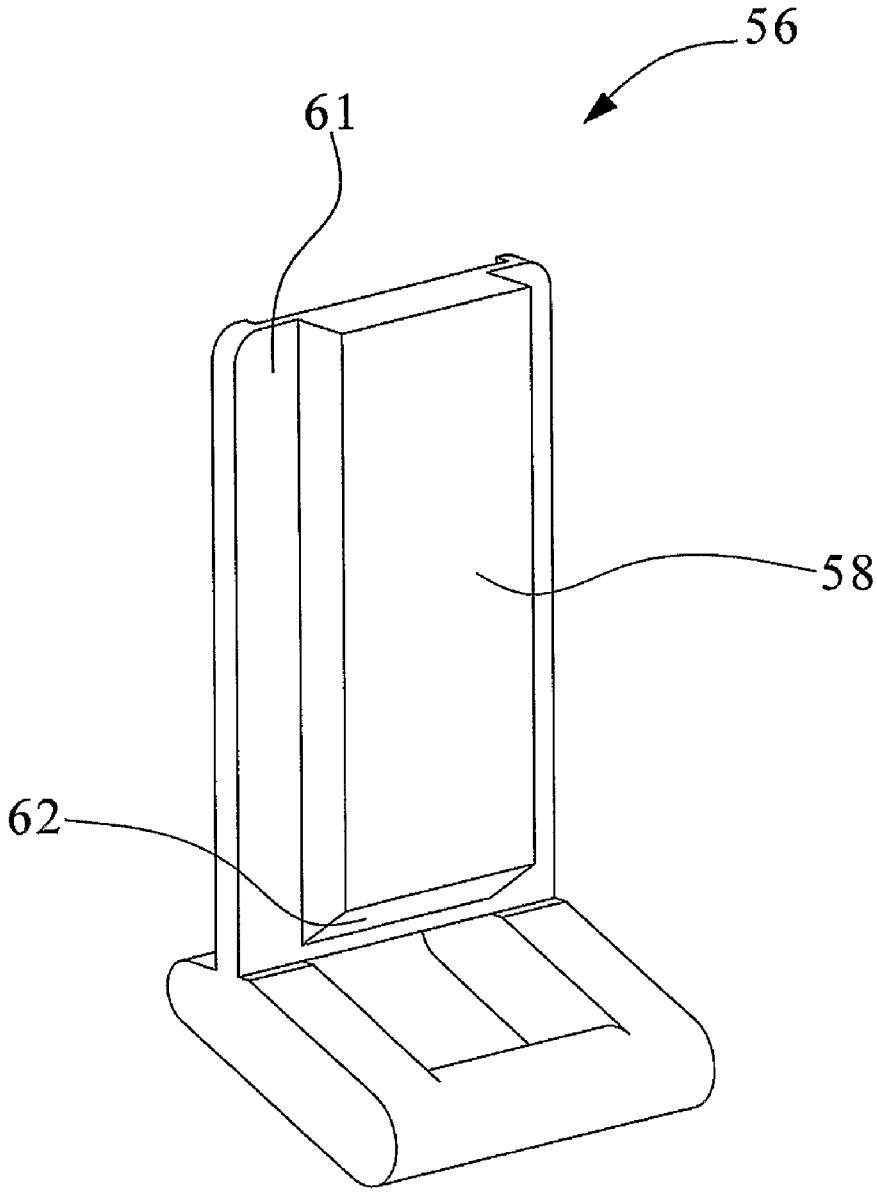
Figure 23:
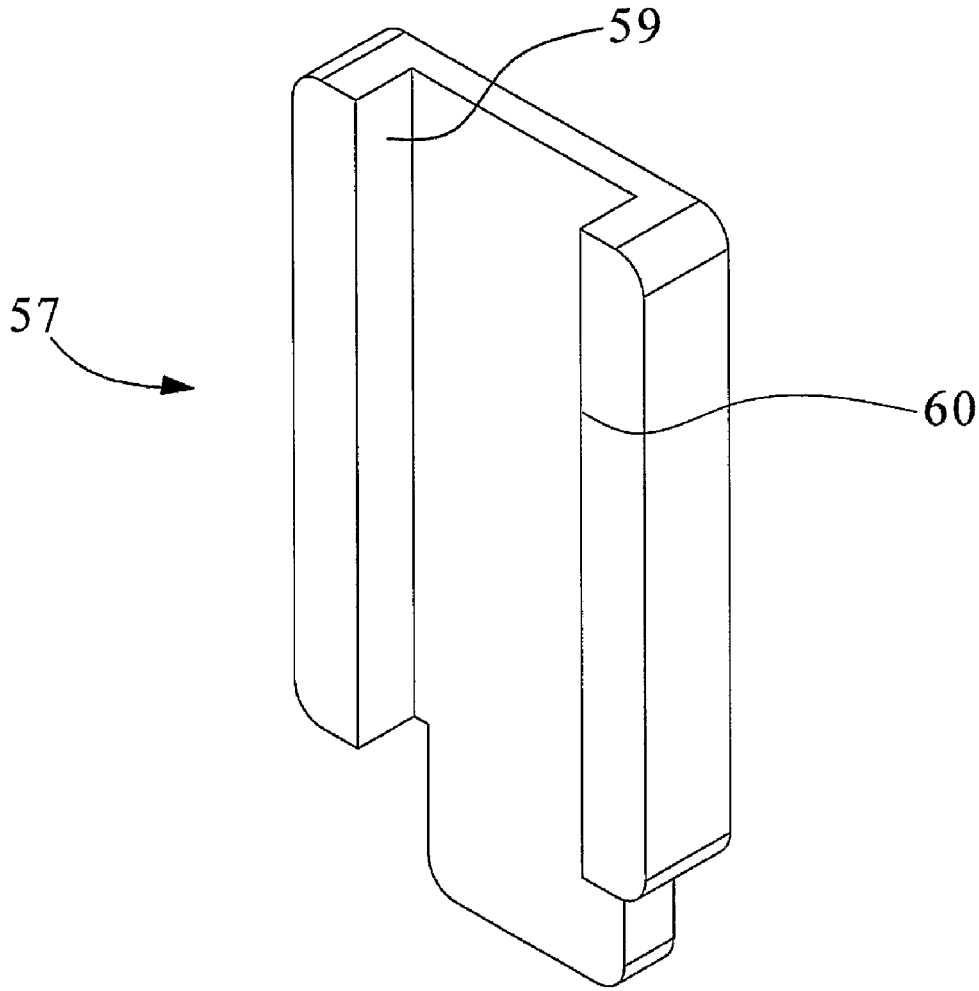
Figure 24:
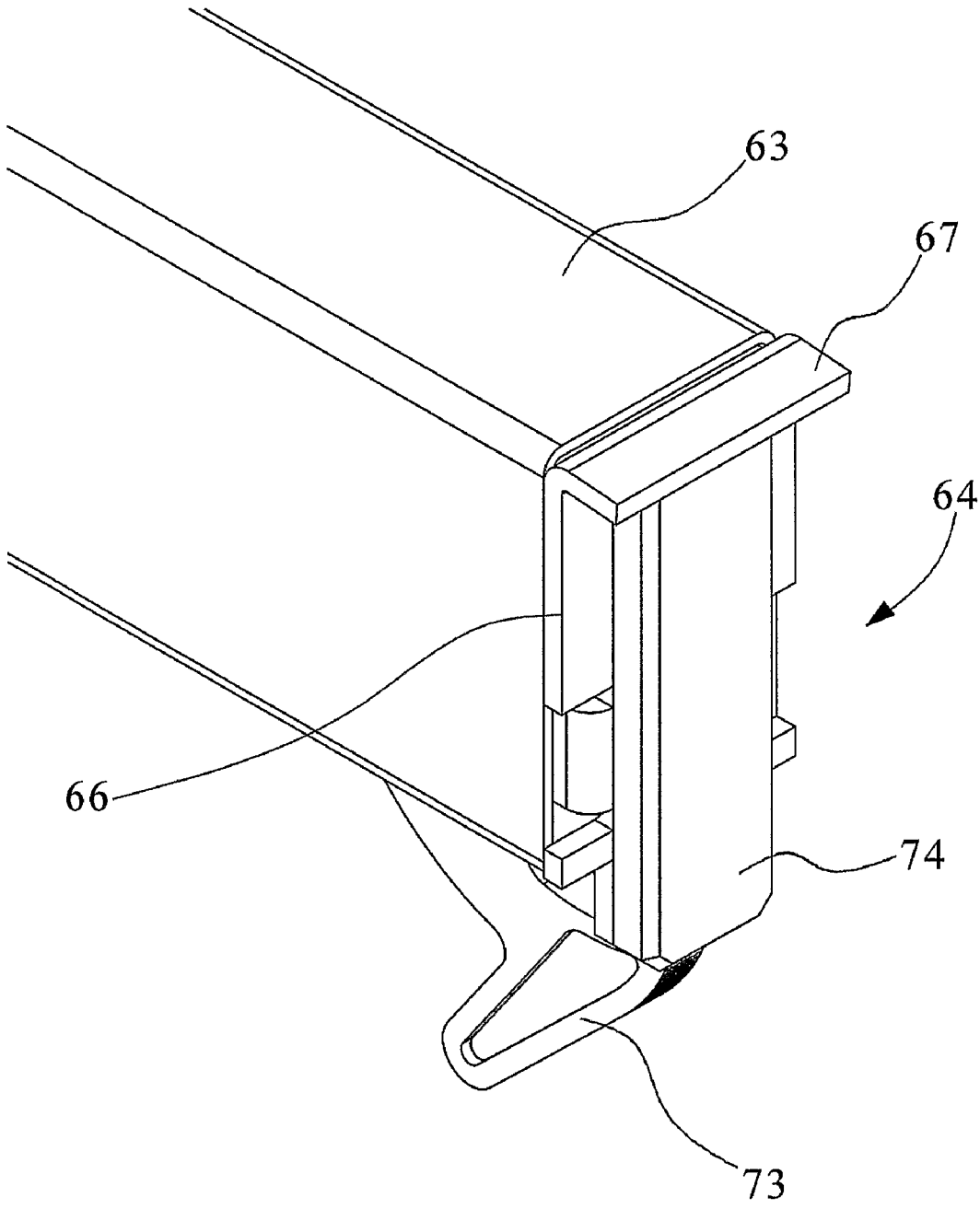
Figure 25:
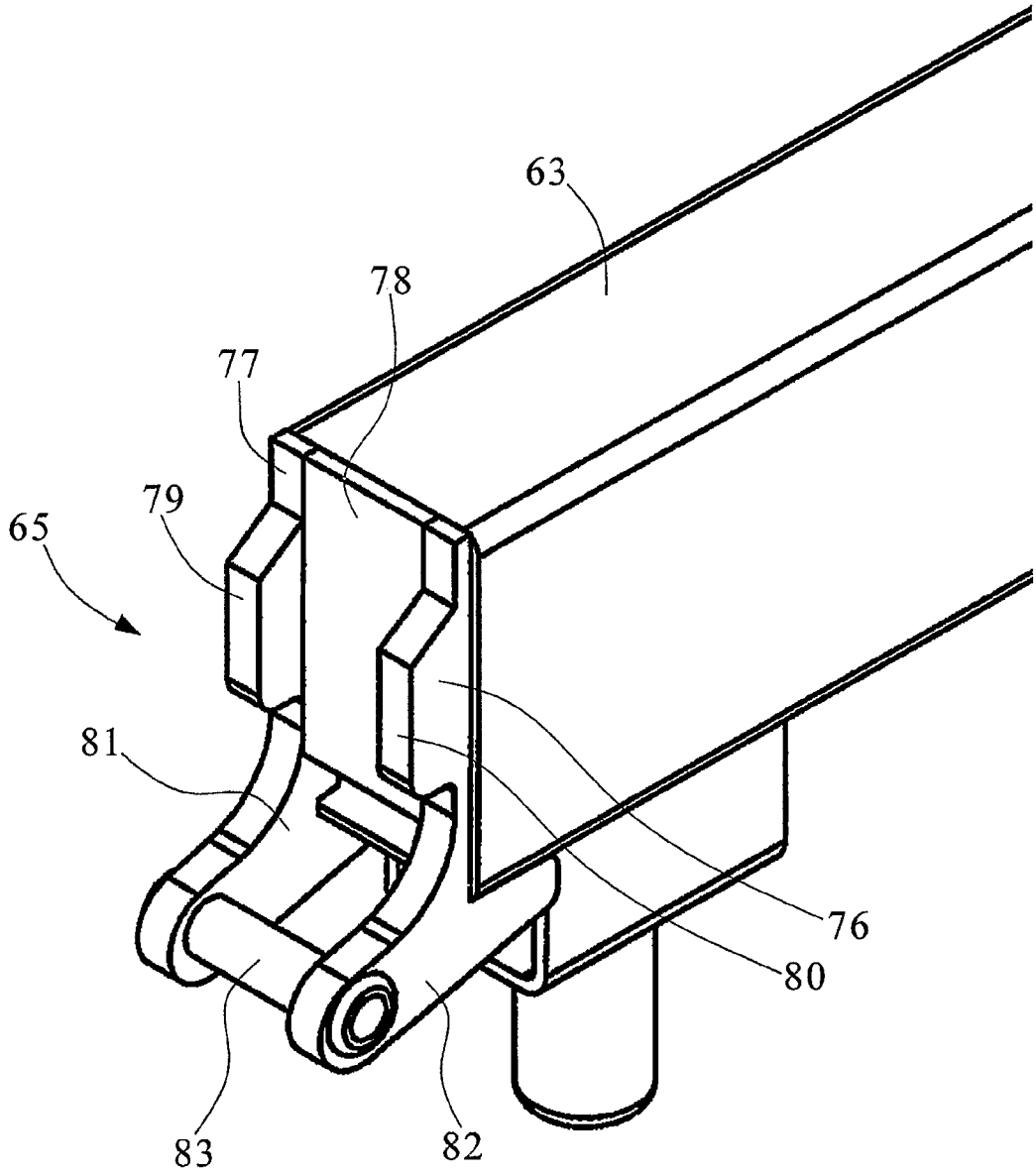
Figure 26:
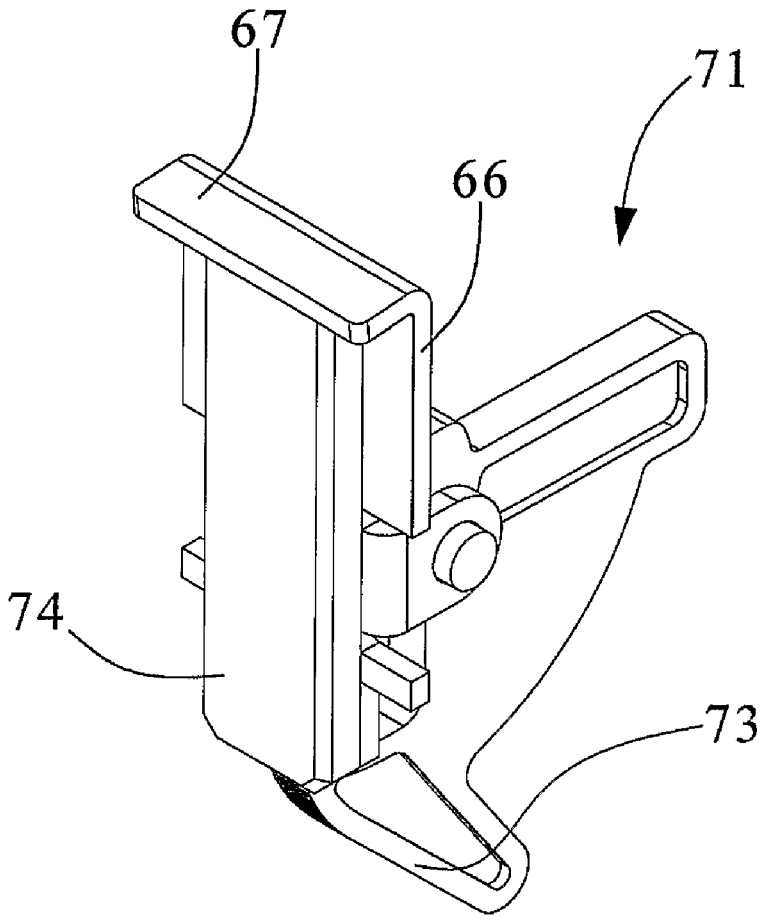
Figure 27:
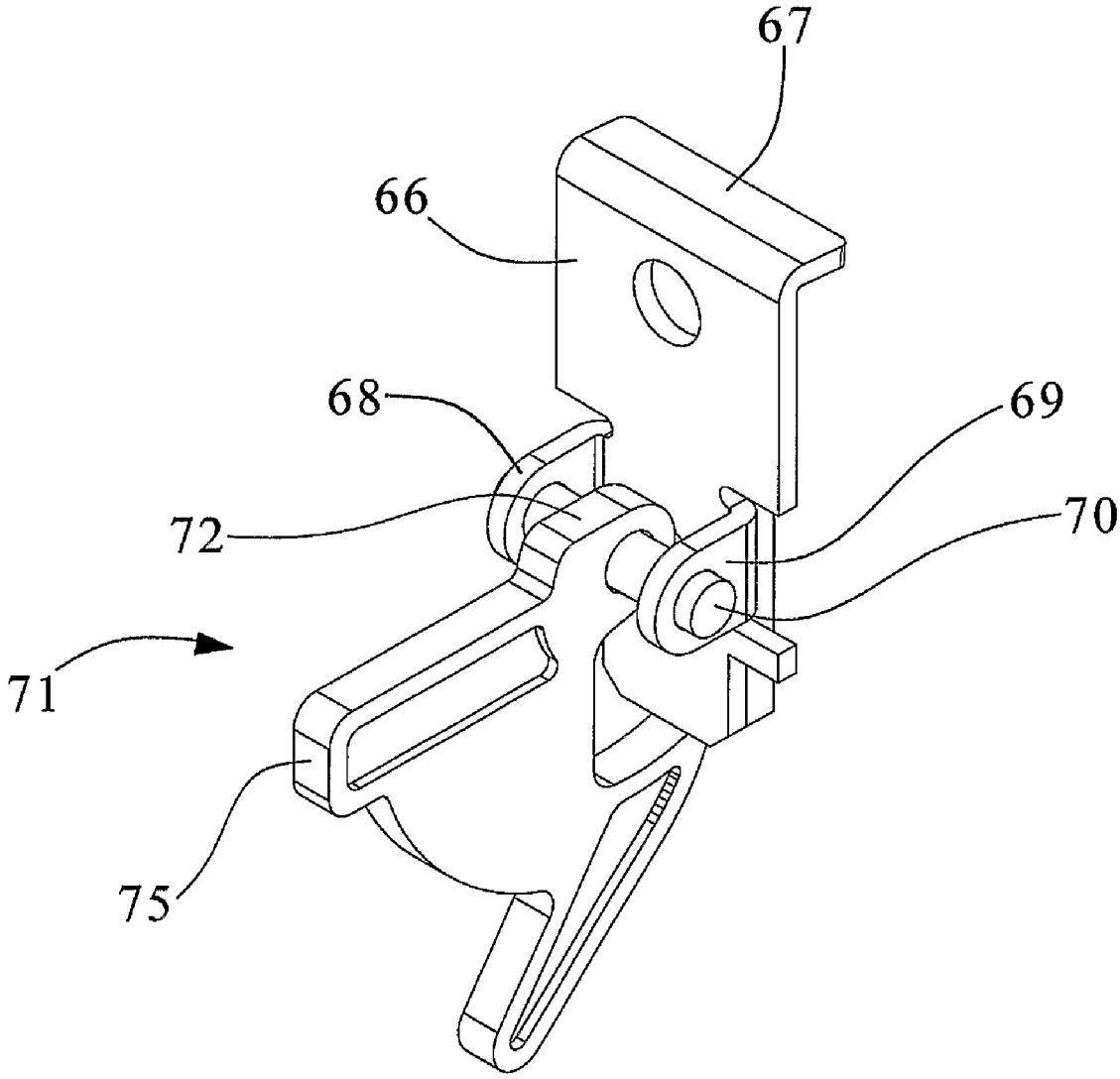
Figure 28:
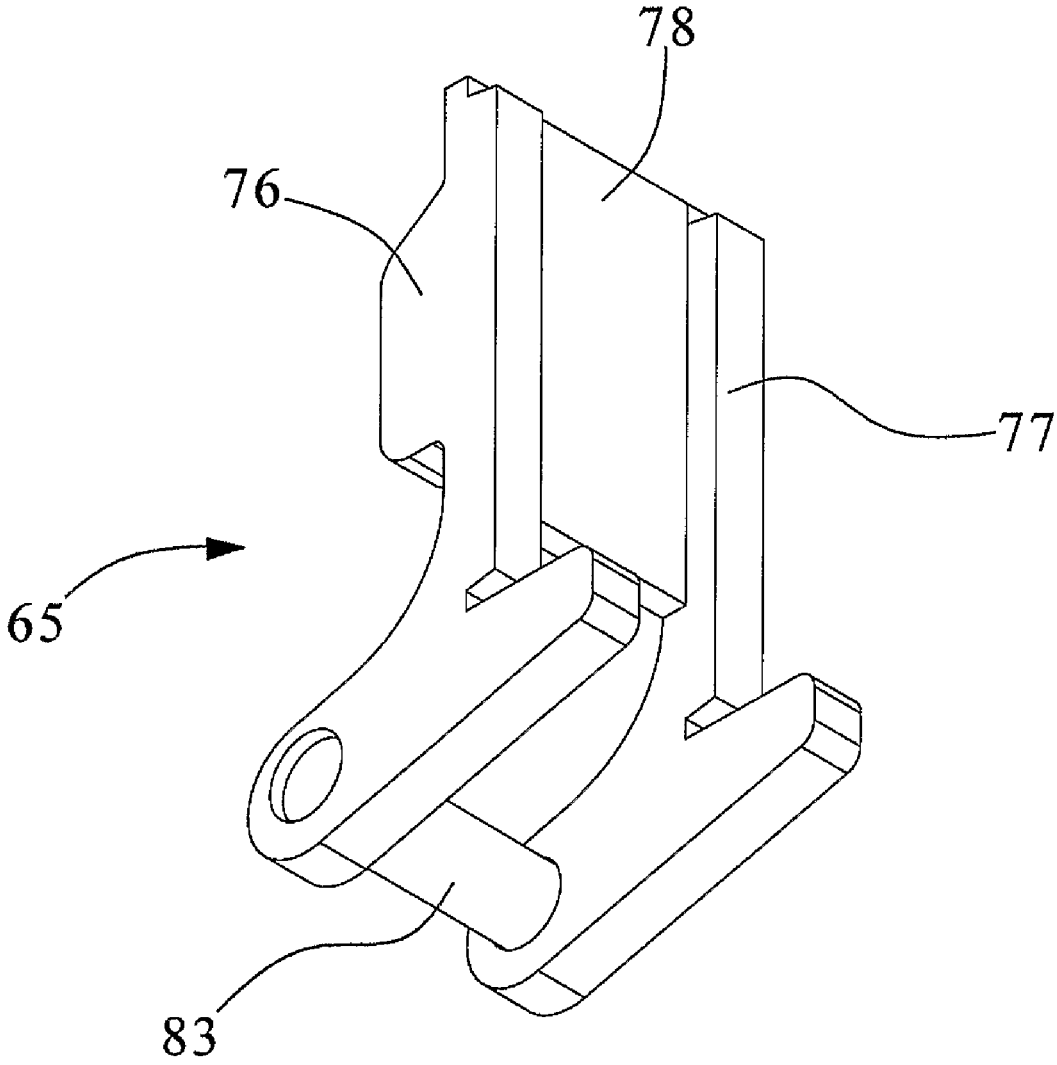
Figure 29:
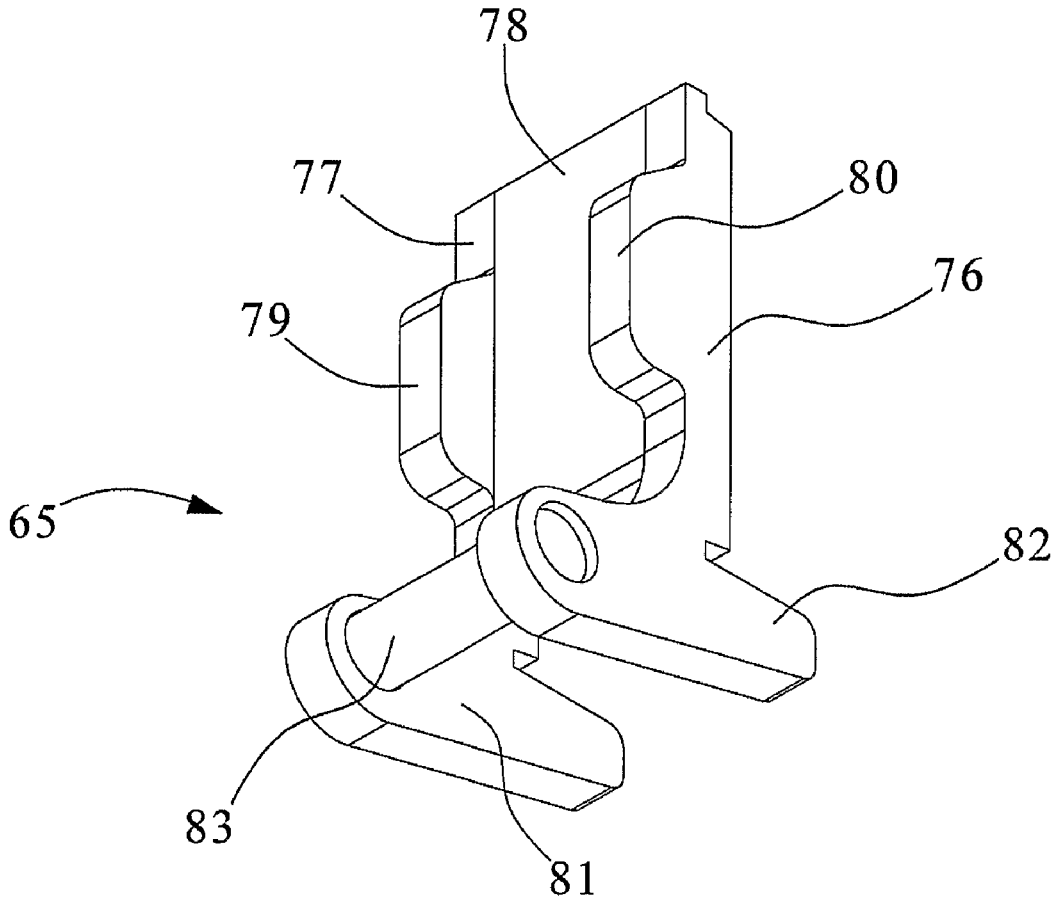
Figure 30:
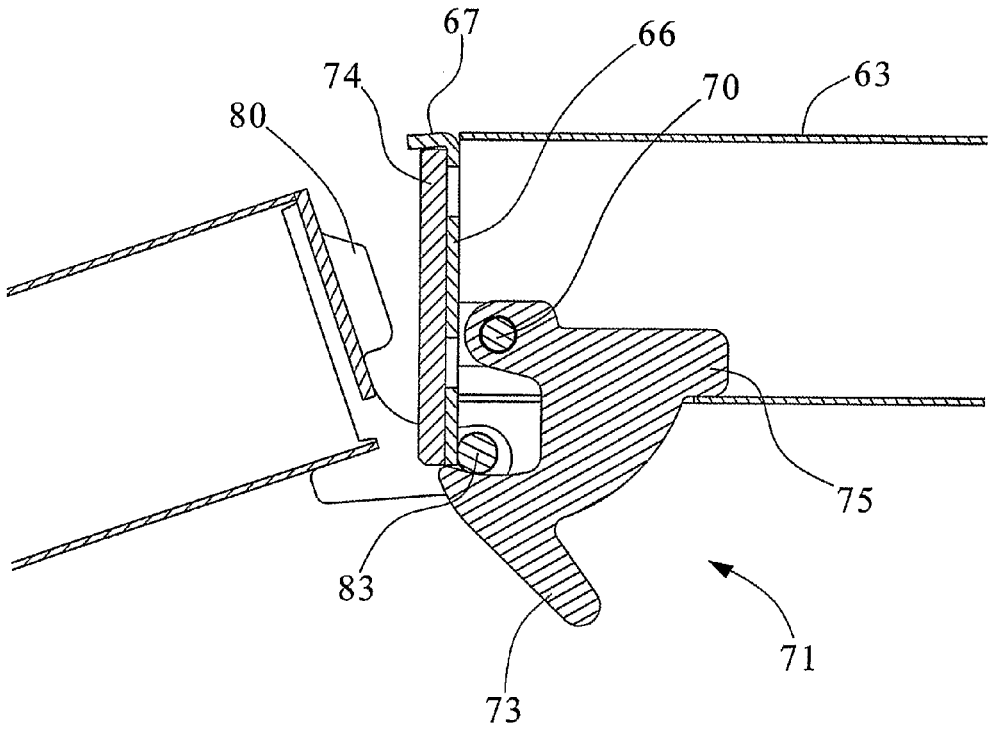

FIGS. 16 and 17 each show front and rear views, respectively, of a variant male part, without the catch incorporated;

FIGS. 18 and 19 show front and rear views, respectively, of a female part as an additional variant;

FIGS. 20 and 21 show front and rear perspective views, respectively, of a male part which can be connected to the female part in FIGS. 18 and 19, without the catch fitted;

FIGS. 22 and 23 represent respectively variants of the female and male part, wherein one terminal is guided into the other by means of a projection on the female part which is introduced in a mating manner between the guides of the male part;

FIGS. 24 and 25 each represent perspective views of beam terminals produced by means of plate elements which have been cut and joined by being welded;

FIG. 26 shows a front view of the terminal in FIG. 24, from its lateral front part;

FIG. 27 is a perspective view of the same element as in FIG. 26, from the rear lateral part;

FIGS. 28 and 29 each show rear and front perspective views of the plate part which supports the bridge for the catch; and FIG. 30 shows a view in cross-section which is representative of the tilting of the support part of the latch relative to the support part of the catch.

Figure 1:
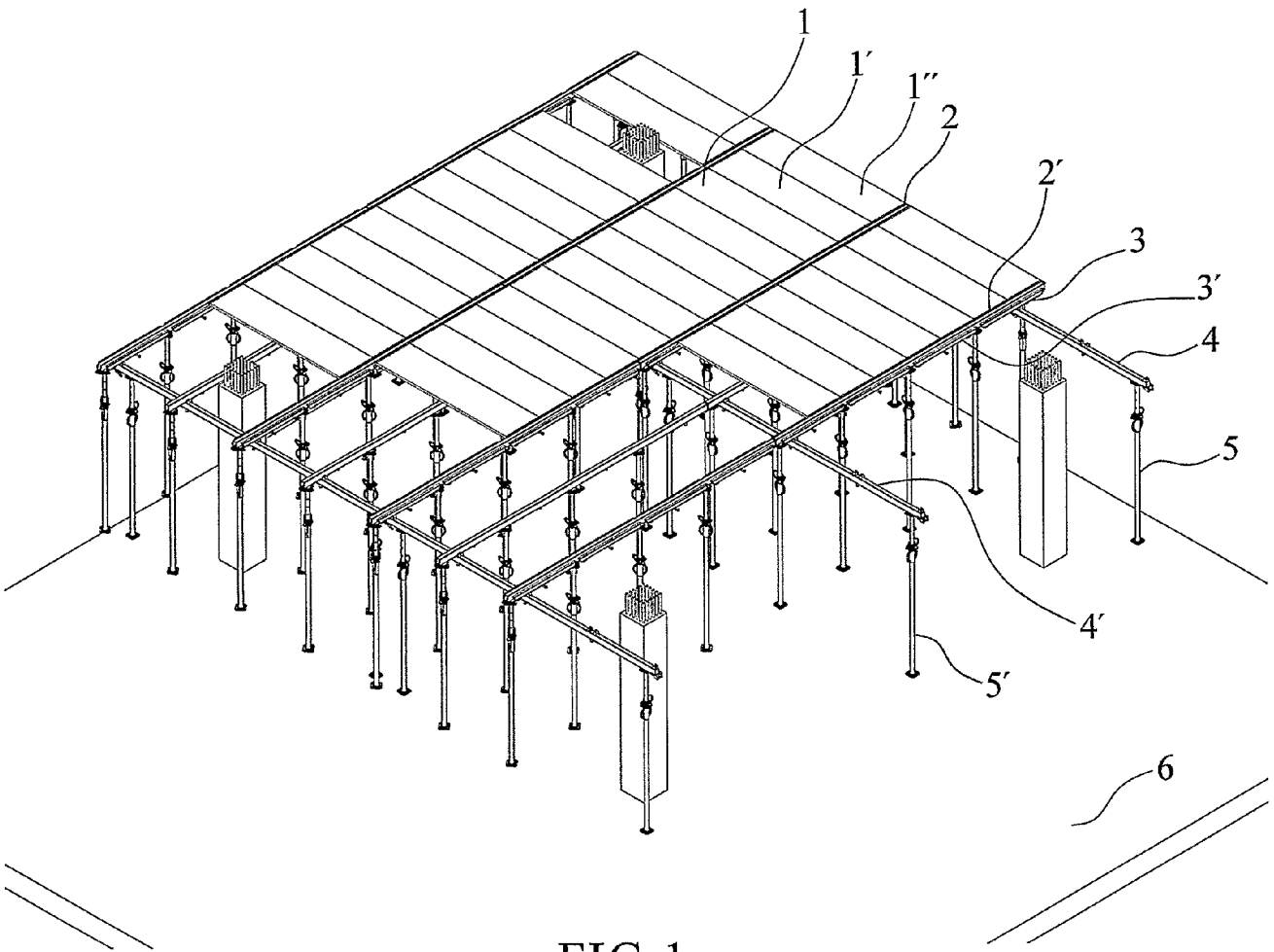
FIG. 1 shows a perspective view of a shuttering assembly for a reinforced concrete floor, in which the present invention is incorporated.

As will be appreciated from the figures, the objective of the present invention consists of producing a purlin beam for shuttering for reinforced concrete floors according to the general arrangement which can be seen in FIG. 1, in which there can be observed multiple panels of concrete shuttering 1, 1', 1" disposed between alignments of purlin beams such as the alignments 2, 2' which support the shuttering panels by means of removable lateral supports 3, 3' which in turn are supported by transverse beams 4, 4', all of which are supported by means of the props 5, 5' on the floor 6 of the lower storey.

Figure 2:
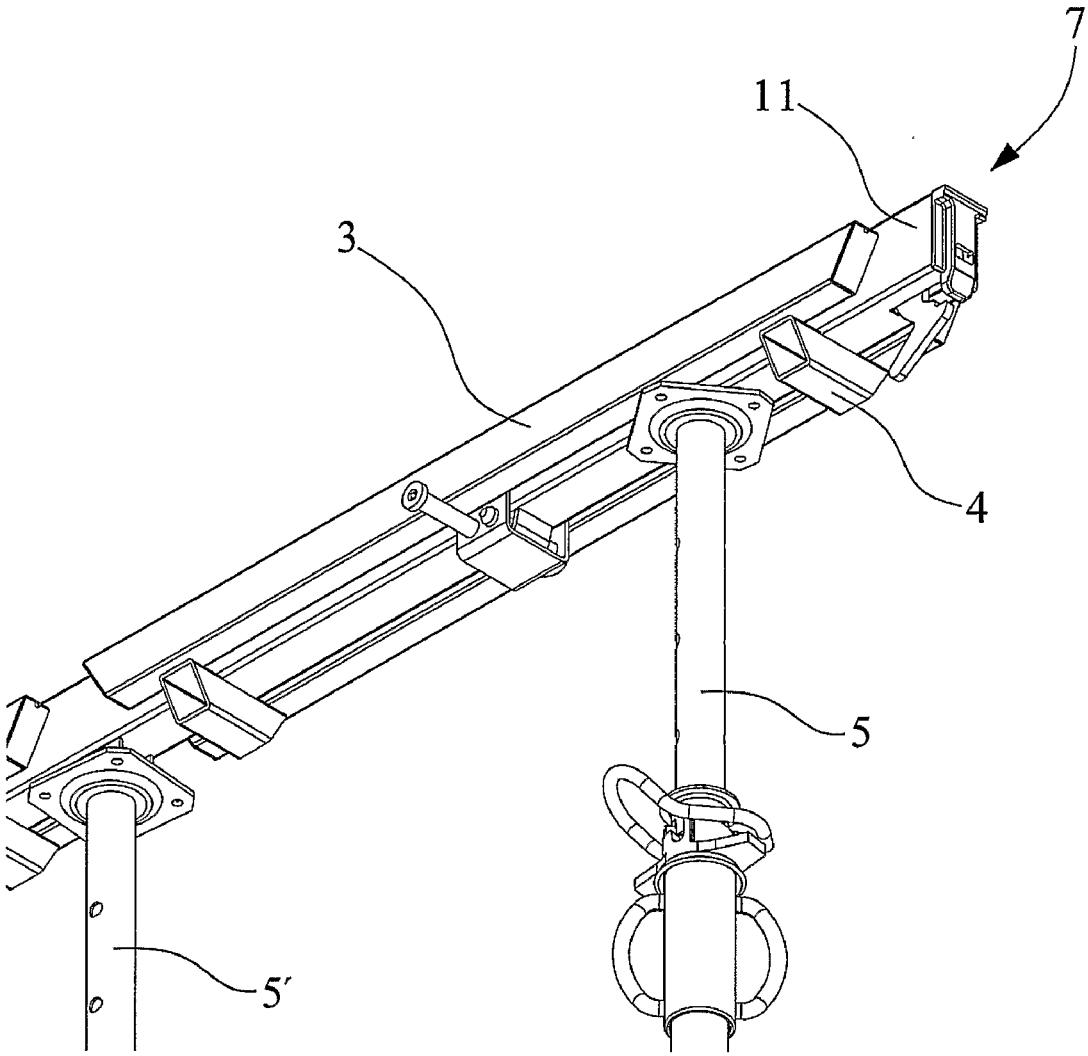
FIG. 2 shows the end of a purlin beam with a male terminal.
Figure 3:
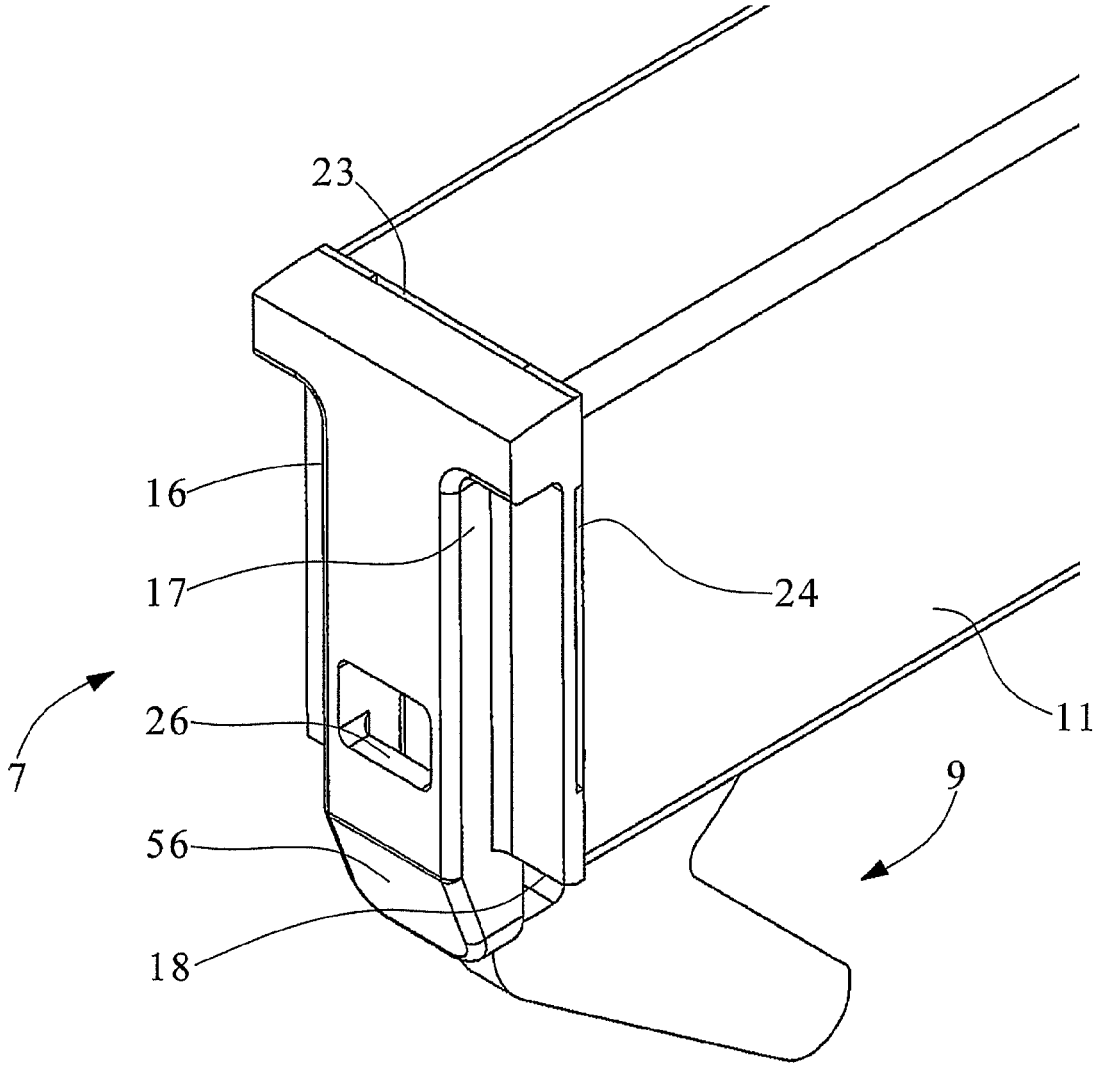
FIG. 3 shows a perspective view of this male terminal on an enlarged scale.
Figure 4:
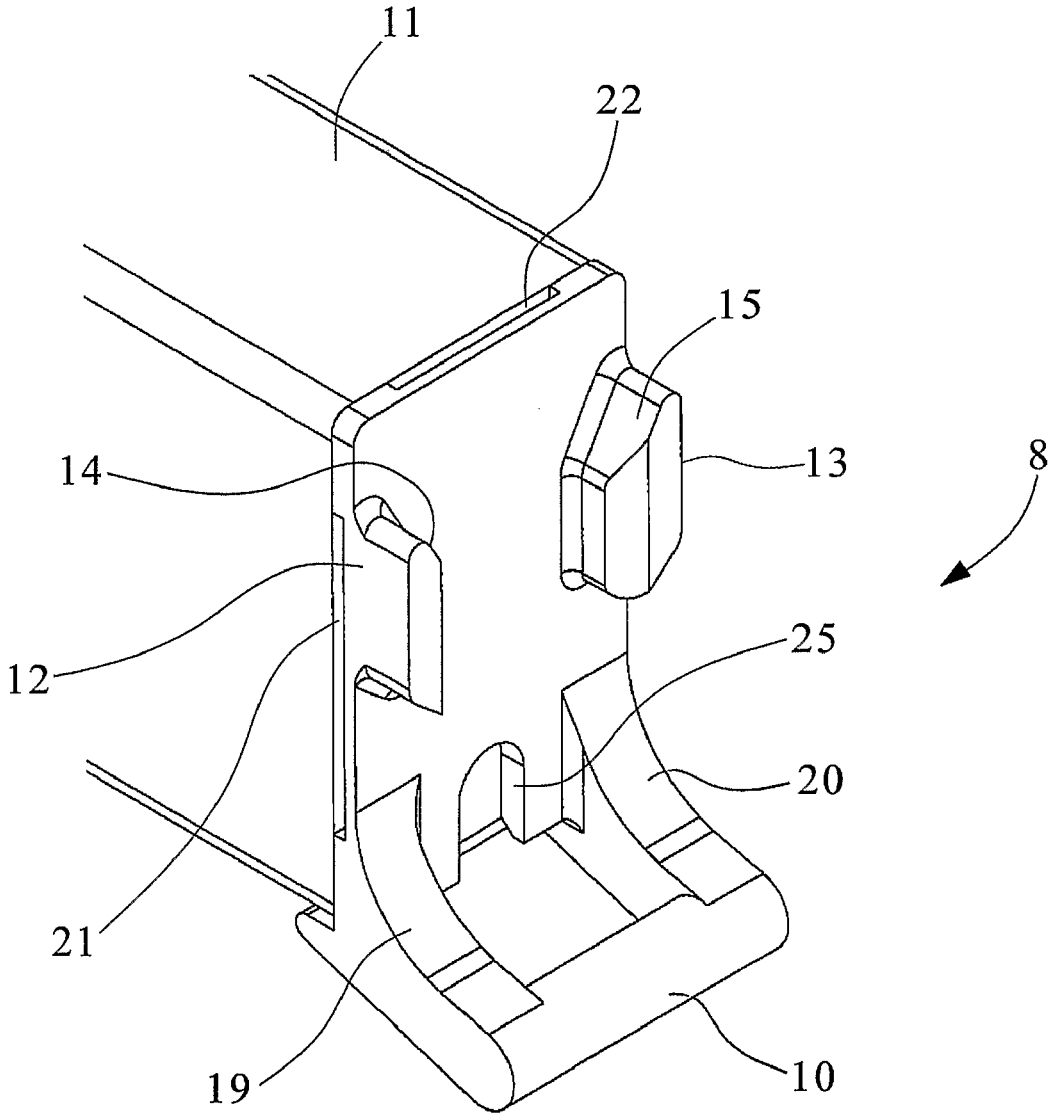
FIG. 4 shows a perspective view of the female terminal.

The purlin beams 2, 2' have at one end a connection terminal, for example a male terminal, as indicated by the number 7 in FIG. 2, and at the other end they have another connection terminal, for example a female terminal, as indicated as a whole by the number 8 in FIG. 4.

The male terminals have a structure which can be nested by vertical sliding into a structure with a mating form of the female part, and also have a retention catch 9, which is designed to be connected with a crossbar 10 of the female part, as will be explained in greater detail hereinafter.

The male and female terminals, 7 and 8 respectively, are each preferably produced from cast parts made from high-strength cast iron, steel, or another resistant material, and are joined by being welded to the ends of the respective tubular elements which complete the purlin beam, such as the tubular element 11 represented in the figures. However, these terminals could also be made of plate elements, as will be explained hereinafter.

In the example represented, the female part 8 has guiding projections 12 and 13, provided with upper chamfers 14 and 15, in order to permit entry of the male part 7, which has straight guides 16 and 17, designed to be nested inside the guiding projections 12 and 13. By this means, it is possible to introduce the male part 7 from the upper part and slide it downwards, guided by the projections 12 and 13, until it reaches a position of support of the lower edges 18 on a specific point of the slightly curved front arms 19 and 20 of the female part 8, which arms end in the front crossbar 10, which is designed to retain the catch, as will be explained hereinafter. Optionally, the male part could incorporate the guiding projections, in which case the female part would have the mating straight guides.

Both the male part 7 and the female part 8 have recesses in the rear peripheral edges, in order to assist the welding, as indicated by the numbers 21, 22, 23 and 24.

The female part also has a lower front opening 25 for drainage of the purlin beam.

A similar opening 26 is provided in the lower front part of the male part 7, which also has a large lower extension with a front chamfer 56, in order to improve the guiding during assembly.

Figure 10:
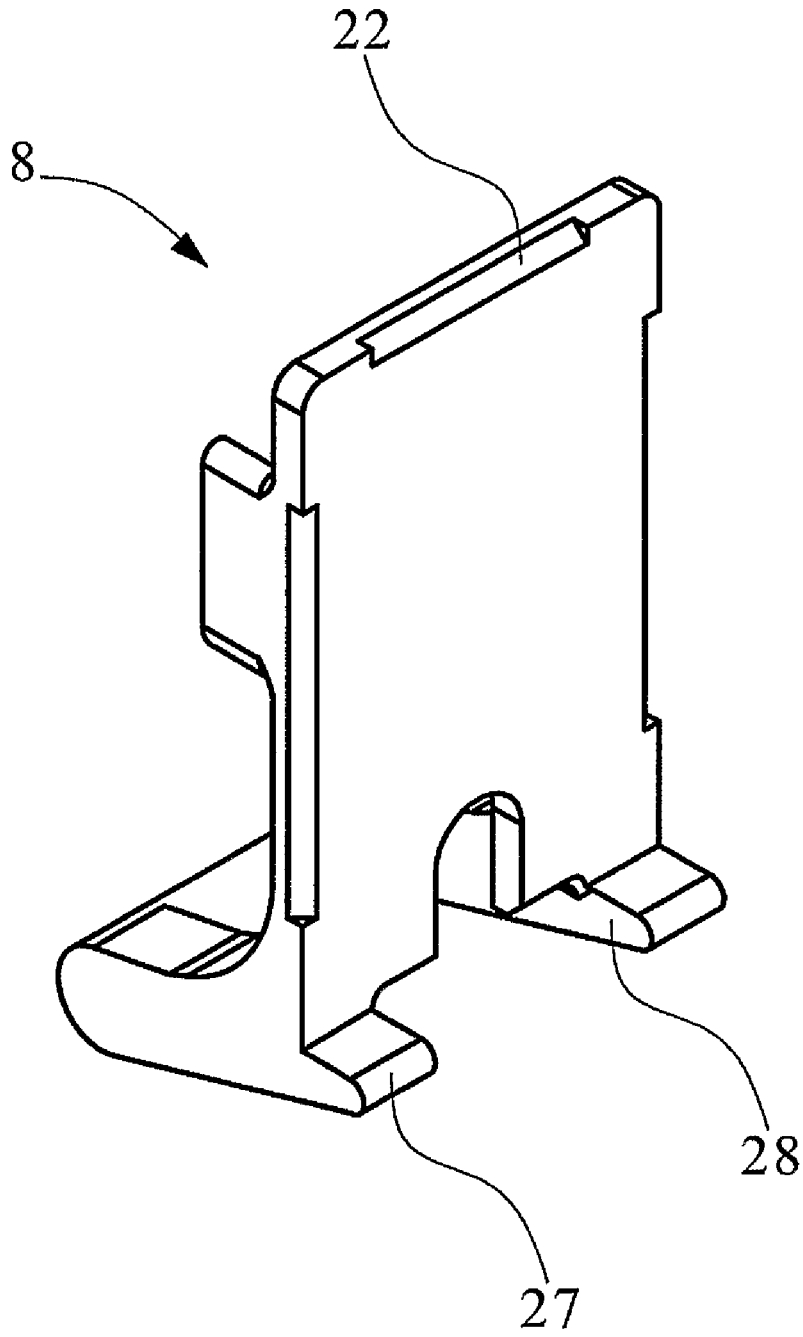
FIGS. 10 and 11 show in detail perspective views of the rear surface and the front surface, respectively, of a female terminal for the purlin beams produced according to the present invention.
Figure 11:
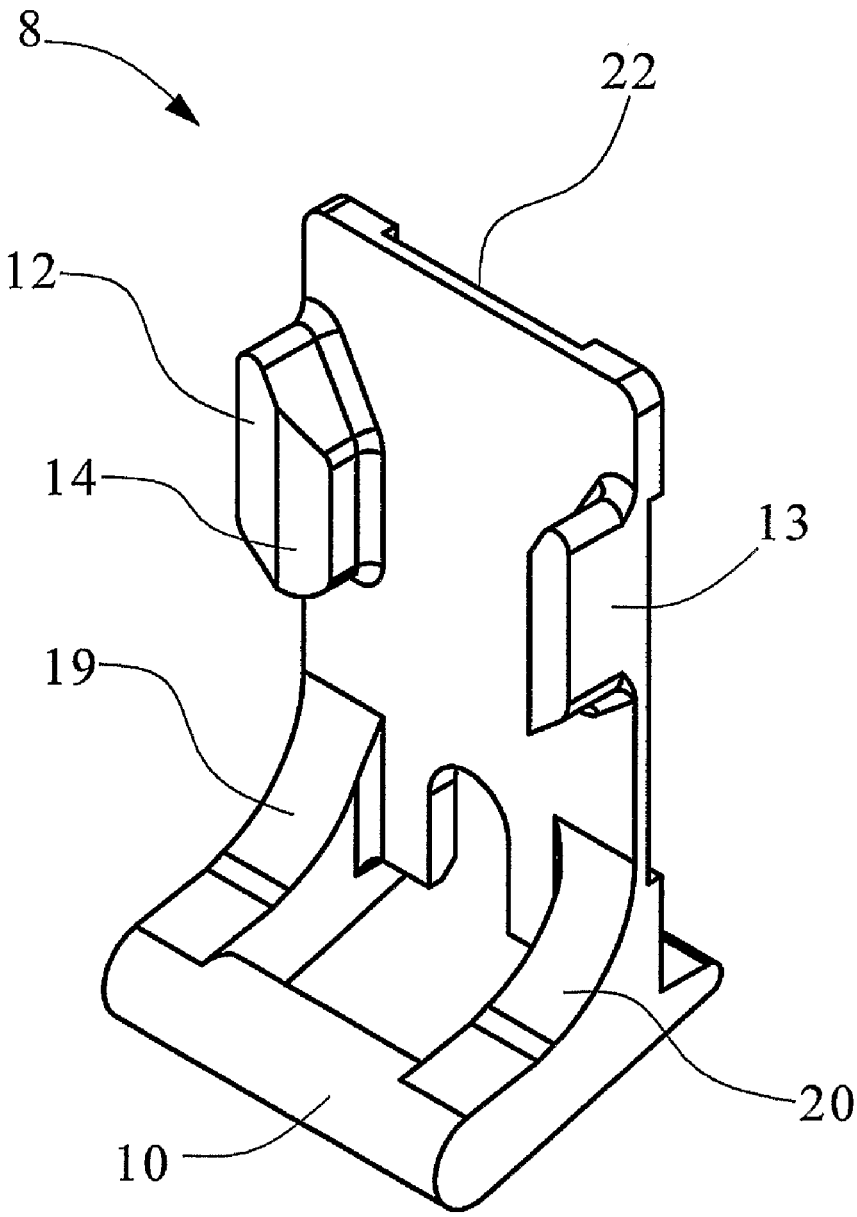
Figure 12:
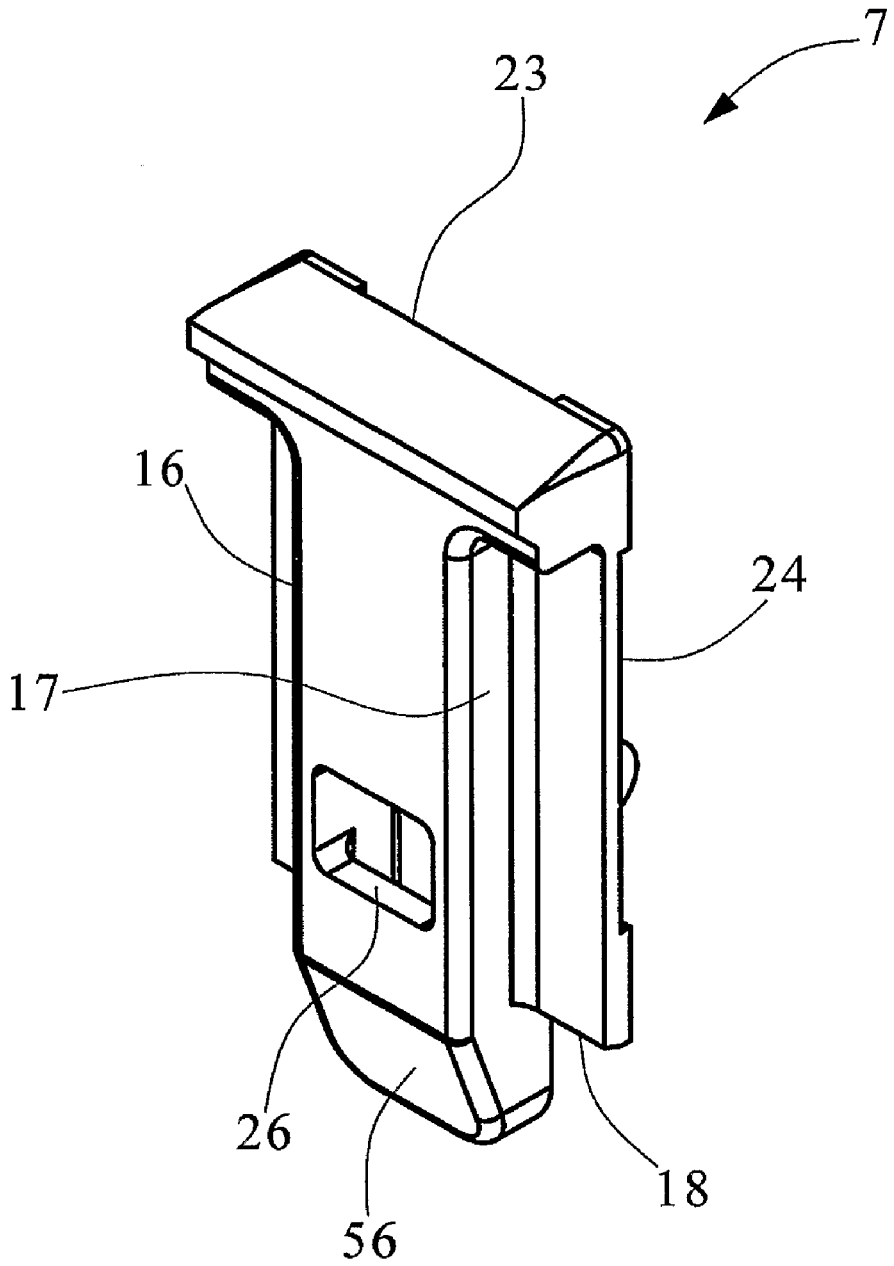
FIGS. 12 and 13 show equivalent views of the front part and the rear part, respectively, of a terminal of the male type, without the catch incorporated.
Figure 13:
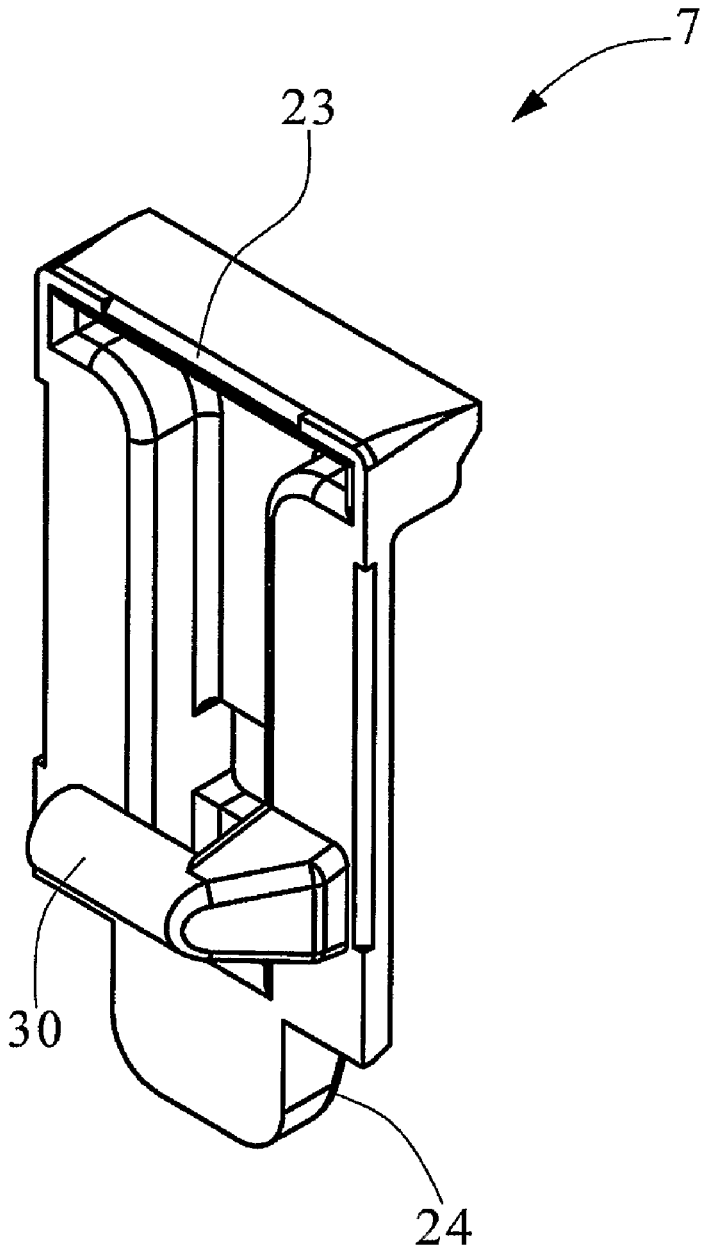

In addition, the female part 8 has positioning projections 27 and 28 on its lower rear part, FIG. 10.

The tilting catch 29 is fitted in a transverse latch 30 associated with the male part 7, which acts in a mating manner with the crossbar 10 of the female part.

Figure 5:
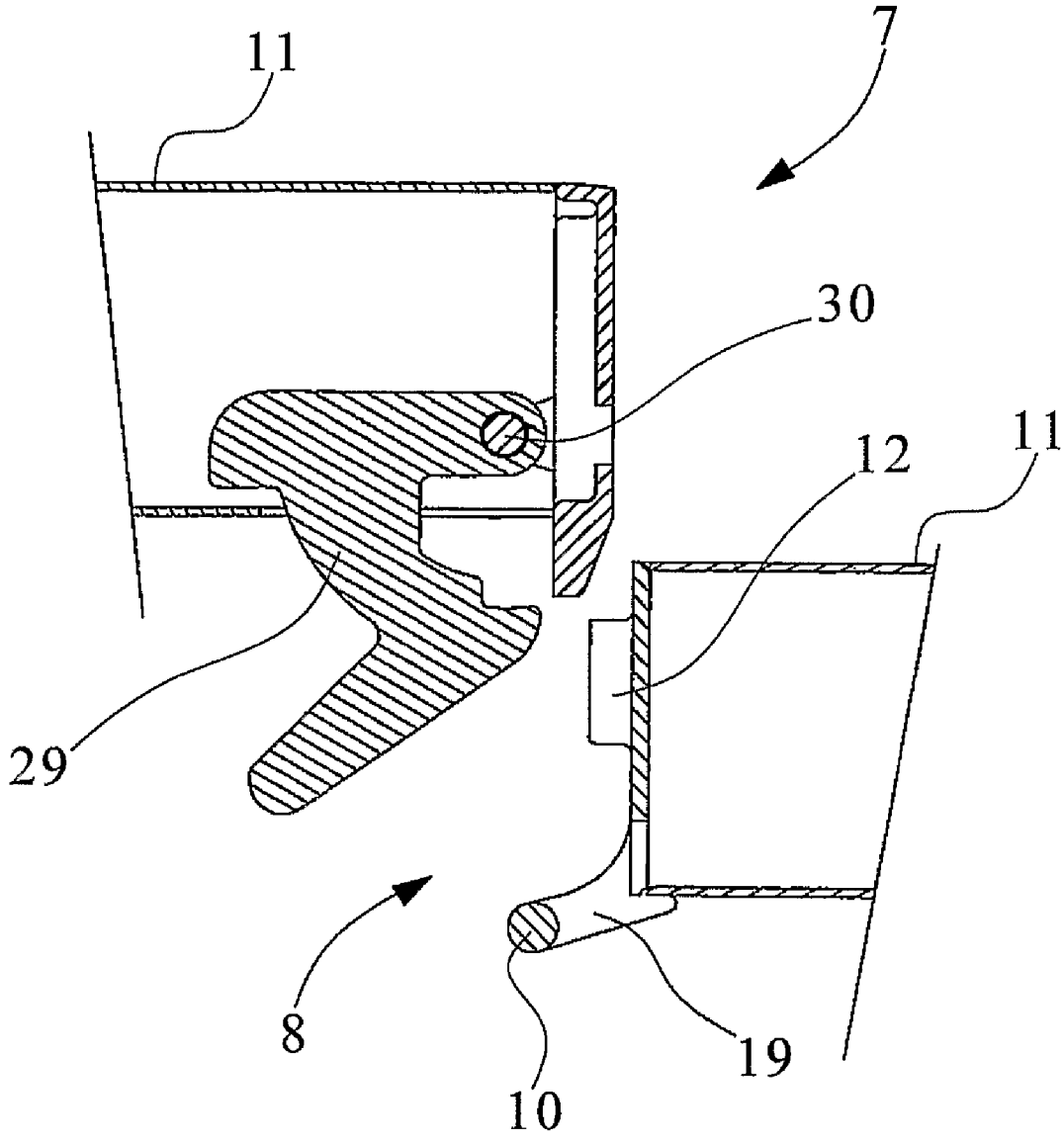
FIGS. 5, 6 and 7 show schematically the positions of two facing terminals of purlin beams produced in accordance with the present invention, in the position of presentation during descent of the male part onto the female part and in the connection position.
Figure 6:
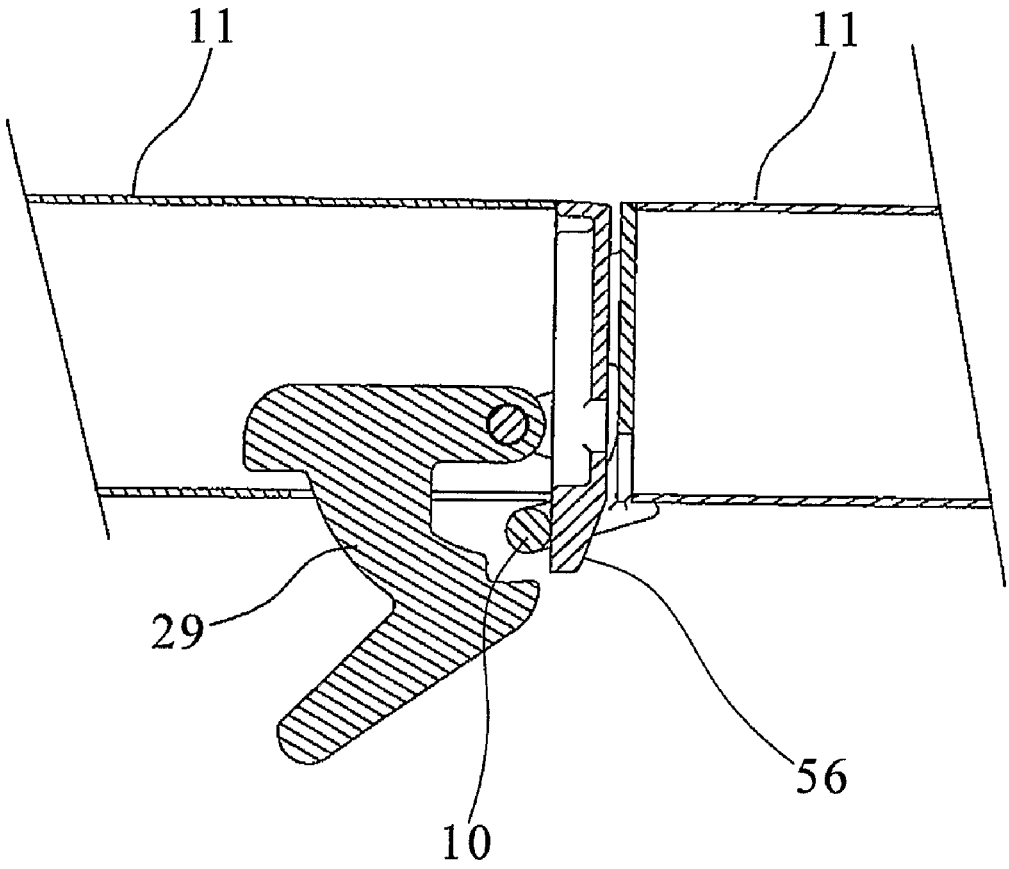
Figure 7:
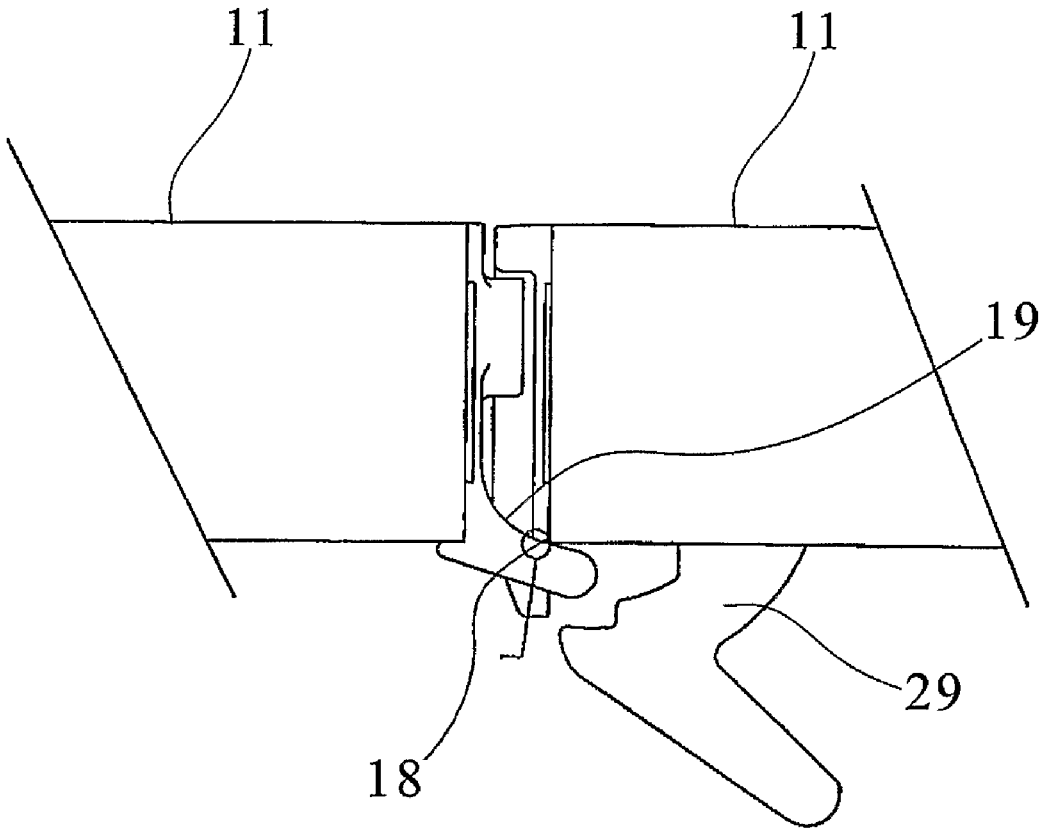

FIGS. 5 to 7 show the connection of two beams via their opposite ends, in the stage of assembly of the shuttering. In FIG. 5 there can be seen the male part 7 at the start of its positioning with respect to the female part 8, and the final position reached can be noted in FIGS. 6 and 7, which shows the relative position of the said male and female parts of two beams facing one another.

Figure 8:
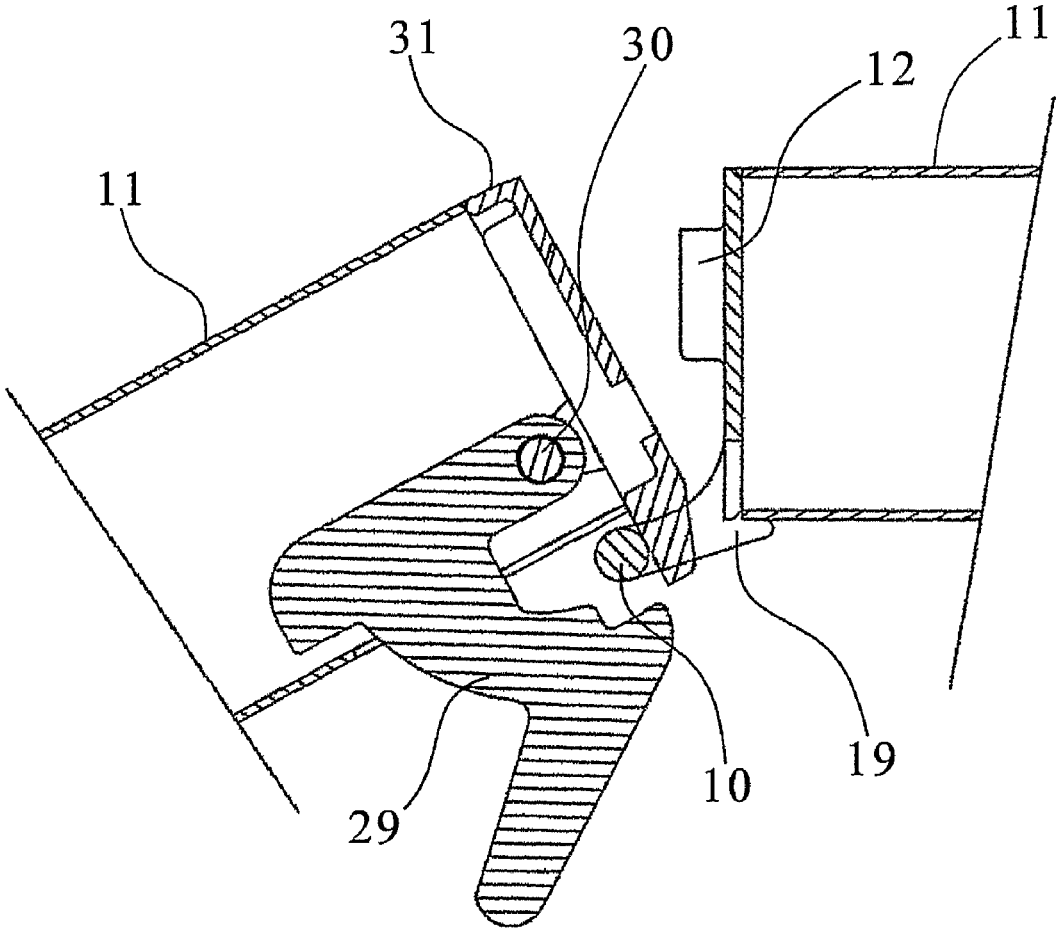
FIGS. 8 and 9 show views similar to 5 and 6, representing the disconnection of two purlin beams according to the present invention, by tilting of the support beam of the male side or of the female side, respectively.
Figure 9:
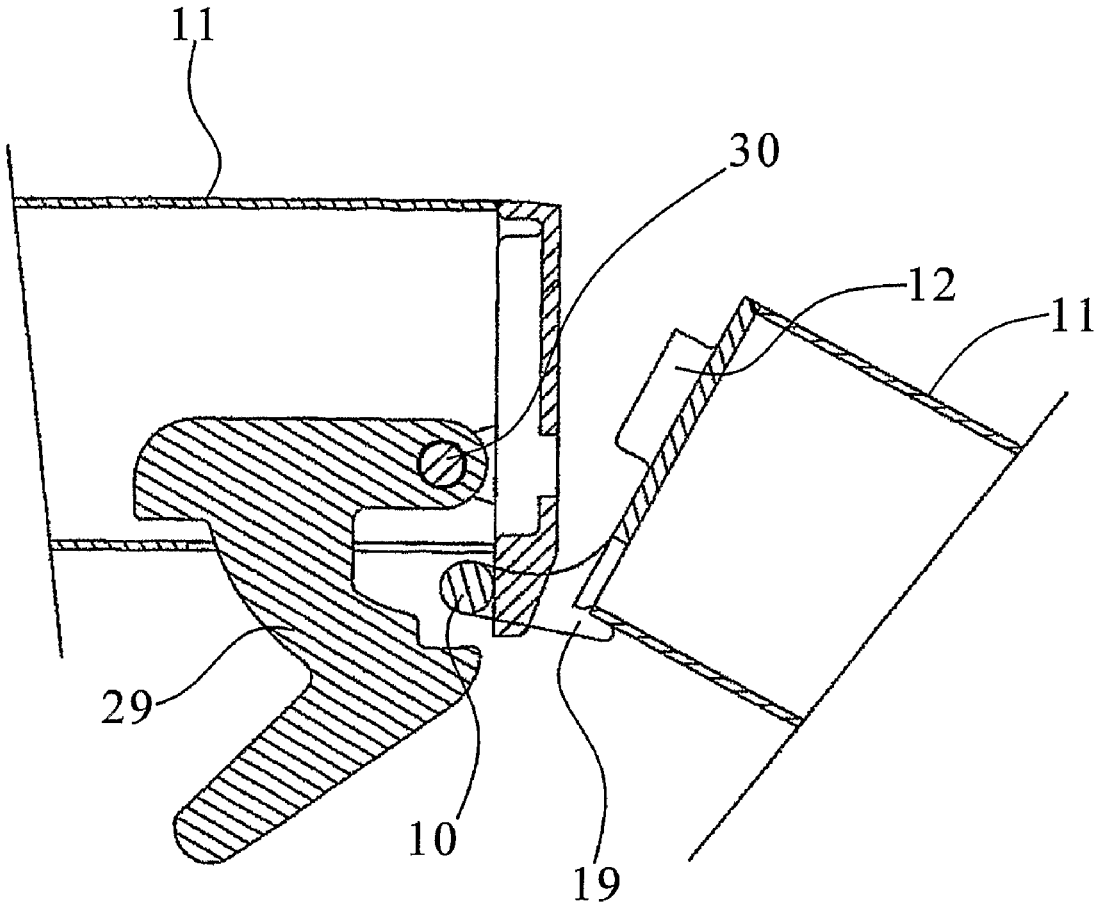

For the purpose of dismantling, during removal from the shuttering, the relative positions will be those which can be seen in FIGS. 8 and 9. In FIG. 9, removal from the shuttering can be seen from the side of the supported terminal, which will turn in the manner indicated and be supported on the crossbar 10, such that the corresponding beam can be suspended. In order to permit turning of the beam without interference with the forged floor parts provided, the upper edge 31 of the male part will have slight curved or inclined chamfering in order to permit correct turning without interference. As is apparent, this will depend on the relative position according to the initial point of turning of the part, which is the point 18 shown in FIG. 7.

FIG. 9 shows removal from the shuttering by means of the female part 11, which, in view of the position of the turning point previously indicated, can be undertaken by direct turning, without any interference, as shown in the figure.

Figure 14:
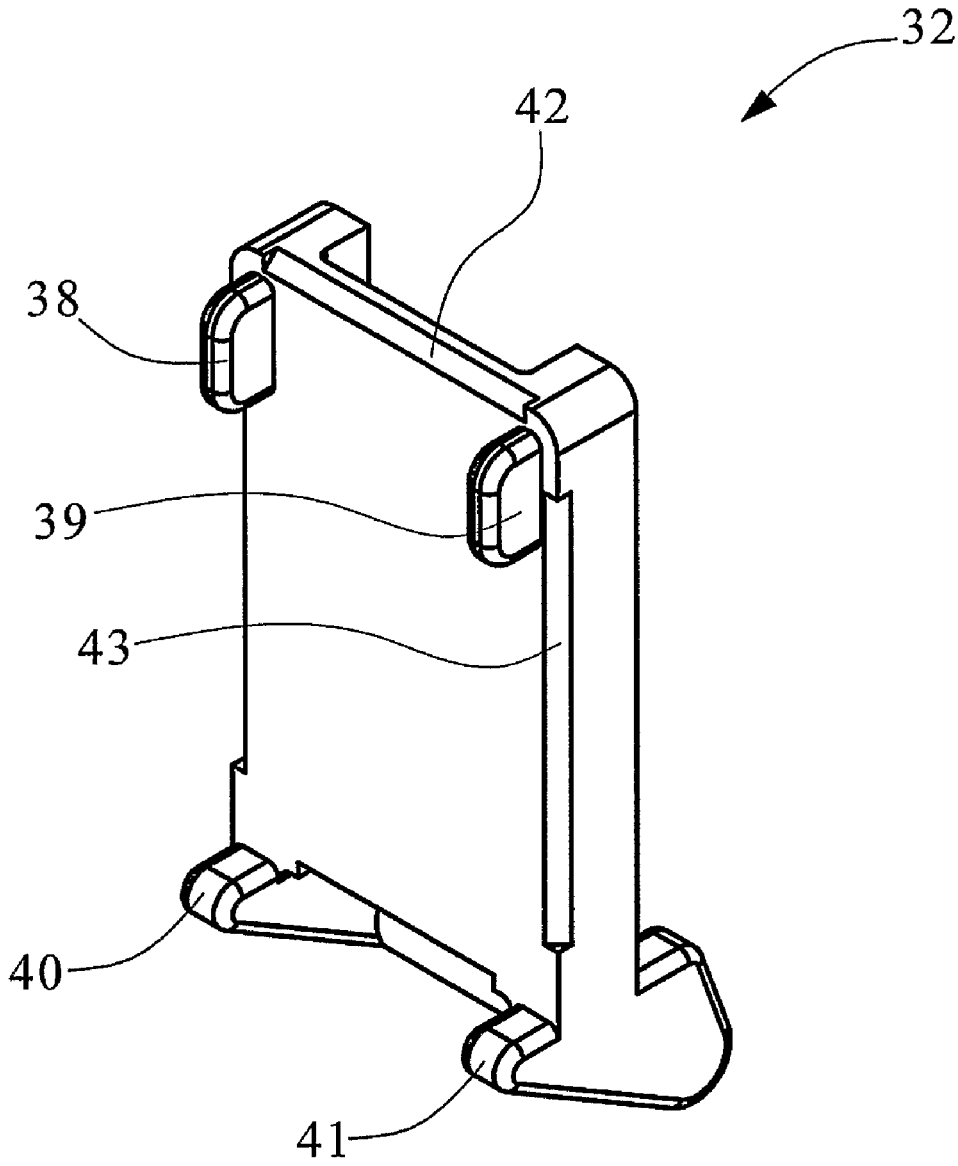
FIGS. 14 and 15 show rear and front perspective views, respectively, of a variant female part.
Figure 15:
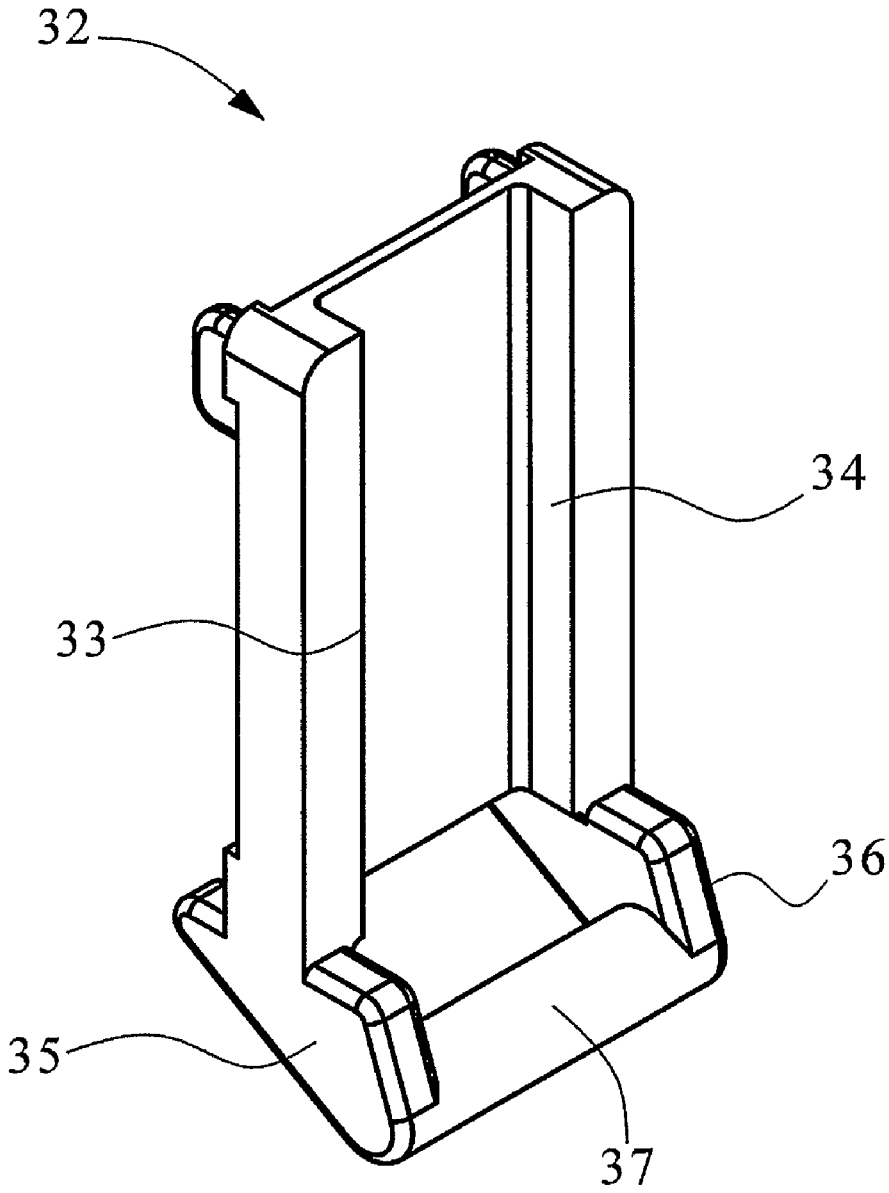

FIGS. 14 to 17 show a variant of the male and female parts which are incorporated in the beam according to the present invention. FIGS. 14 and 15 show a female part 32 provided with straight guides which extend from the upper part to the lower part of the part, and are indicated by the numbers 33 and 34. Lower reinforcements 35 and 36 support the crossbar 37. In the rear part, the part has upper centring projections 38 and 39, and the lower projecting heel plates 40 and 41, as well as the chamfers 42 and 43, in order to permit welding to the tubular elements of the beams.

FIGS. 16 and 17 show the male part 44 provided with straight guides 45 and 46 which also extend from top to bottom of the part, and are designed to coincide in the interior of the guides 33 and 34 of the female part. Rear wings 47 and 48 are designed to receive the catch articulation latch.

FIGS. 18 to 21 show another variant of the said male and female parts. The female part 49 is shown in FIGS. 18 and 19 and the male part 50 is shown in FIGS. 20 and 21. In this case, the guides 51 and 52 of the female part are in the form of an acute angle, with the vertex situated on the lower part, corresponding to the guides 53 and 54 of the male part 50, which in its rear part supports the latch 55 for the catch.

In the figures, the latch 10, 55 for the catch is shown as being integral with the terminal, although it will be apparent that the latch could be produced separately.

FIGS. 22 and 23 both show variants of the female part, indicated by the number 56, and of the male part, indicated by the number 57. The variant consists substantially in that the guiding of one terminal into the other can be carried out by means of a projection, for example a projecting block 58 of the female part which is introduced in a mating manner between the guides 59 and 60 of the male part 57, which in this case is represented in an incomplete form, in other words without the connection of the catch which can take place as in the other examples represented. The front block 58 of the part 56 will preferably have straight lateral guides which are perpendicular to the rear plate 61, and a lower chamfer 62.

It should be explained that although the crossbar for the catch, which is shown as number 10 in the figures, is represented as being integral with its own terminal in a single piece, which is preferably made of cast iron, it could also be incorporated in the form of a separate part, fitted by means of any known system, into the remainder of the single-piece terminal.

FIG. 24 onwards show versions of terminals made of cut, doubled and welded pieces of plate. FIG. 24 shows the beam 63, which has the male terminal 64, at an end which corresponds to the female terminal 65 of the other end, shown in FIG. 25.

Both terminals 64 and 65 are constituted on the basis of plate handled by the habitually known technologies of cutting, forming, drilling and welding, thus constituting the corresponding terminals. The embodiment in FIG. 24, which is shown in greater detail in FIGS. 26 and 27, shows the arrangement of a front plate 66 with an upper flange 67 and the lateral wings 68 and 69 which are designed to receive the shaft 70 in order to receive the body of the catch 71, which is articulated by means of the upper journal 72 on the shaft 70, and has on its lower part the actual hook 73 of the catch. The front guide part 74 is produced by means of a rectangular plate which is welded onto the front of the plate 66. Both the plate 66 and the front guide plate 74 are extended at the base relative to the beam, as can be seen in FIG. 30. In the same figure it can be seen that the rear extension 75 of the catch 71 is designed to abut the inner surface of the lower side of the beam 63.

In the example represented in FIGS. 25, 28, 29 and 30, the female terminal is constituted by means of lateral plate parts 76 and 77, which are welded onto an intermediate plate 78. The lateral parts 76 and 77 have the projections 79 and 80 for guiding of the detachable plate 74, thus forming the assembly for straight guiding of the two end terminals of two connected beams. The lateral parts 76 and 77 themselves have on their lower part extensions 81 and 82, which on one side have apertures for incorporation of the shaft 83 which is designed for interaction with the catch 71.

It will be understood that the invention is not limited to the specific embodiment which has been explained by way of example and represented in the attached drawings. On the contrary, persons skilled in the art will be able to introduce into it multiple variations which will be included in the scope of the invention, provided that they correspond to the characteristics defined in the attached claims.

The invention claimed is:

1. A purlin beam with connectable terminals, comprising:

a male terminal at one end and a female terminal at the other end, which can be connected to one another, wherein the female terminal is provided with front projections for guiding in vertical displacement of the male terminal, which has a pair of straight guides with a form which mates with the front projections, the female terminal also having projecting lower arms to support the male terminal after the male terminal has been put into position, thus determining a single area of contact in order to permit disconnection of the supported male terminal during dismantling, by turning on the said area of contact, wherein a central portion of the male terminal includes a single lower extension projecting in a longitudinal direction of the beam, the straight guides being formed on opposite lateral sides of the single lower extension and extending parallel to the longitudinal direction of the beam, the straight guides of the single lower extension being adapted to be nested between the front projections of the female terminal.

2. A purlin beam with connectable terminals according to claim 1, wherein the male and female terminals are made of unitary metal parts which are connected by being welded to tubular elements which form the beam.

3. A purlin beam with connectable terminals according to claim 2, wherein the male and female terminals are made of cast metal.

4. A purlin beam with connectable terminals according to claim 3, wherein the female terminal includes a crossbar for a catch of the male terminal, each of the crossbar and the catch being produced integrally with a corresponding cast terminal.

5. A purlin beam with connectable terminals according to claim 1, wherein each of the male and female terminals has chamfered areas on rear edges thereof in order to permit welding with a tubular element which forms the beam.

6. A purlin beam with connectable terminals according to claim 1, wherein the front projections of the female terminal have discontinuous guiding abutments which are parallel with one another, the front projections also being provided with upper chamfers in order to assist entry of the male terminal, which is provided with the straight guides designed to coincide between surfaces opposite one another of the guiding abutments.

7. A purlin beam with connectable terminals according to claim 1, wherein which the straight guides extend from an upper part to a lower part of the male terminal, and abut against the front projections of the female terminal.

8. A purlin beam with connectable terminals according to claim 1, wherein the male and female terminals have angled guides which mate with one another so as to coincide during connection.

9. A purlin beam with connectable terminals according to claim 1, wherein the male and female terminals are made of plate elements formed so that the male and female terminals are capable of being joined by being welded to one another and to a tubular element which forms the beam.

10. A purlin beam with connectable terminals according to claim 1, wherein an upper edge of the supported male terminal is slightly chamfered in curvature or inclination in order to allow male terminal to be turned without interference.

11. A purlin beam with connectable terminals, comprising:

a male terminal at one end and a female terminal at the other end, which can be connected to one another, wherein the female terminal is provided with a pair of front projections for guiding in vertical displacement of the male terminal, which has guides with a form which mates with the front projections, the female terminal also having a pair of curved projecting lower arms to support the male terminal after it has been put into position, thus determining a single area of contact in order to permit disconnection of the supported male terminal during dismantling, by turning on the said area of contact, and further comprising:

a crossbar extending laterally between forward most ends of the curved projecting lower arms.

12. A purlin beam with connectable terminals according to claim 11, wherein the crossbar of the female terminal is adapted to be connected with a catch of the male terminal.

13. A purlin beam with connectable terminals according to claim 11, wherein the front projections of the female terminal have discontinuous guiding abutments which are parallel with one another, the front projections also being provided with upper chamfers in order to assist entry of the male terminal, which is provided with the guides designed to coincide between surfaces opposite one another of the abutments.

14. A purlin beam with connectable terminals according to claim 11, wherein the crossbar extending laterally between the forward most ends of the curved projecting lower arms is spaced apart from the front projections.

* * * * *